US009715217B2

(12) United States Patent
Di Domenico et al.

(10) Patent No.: US 9,715,217 B2
(45) Date of Patent: Jul. 25, 2017

(54) DEVICE INTENDED TO CONTROL THE ANGULAR SPEED OF A TRAIN IN A TIMEPIECE MOVEMENT AND INCLUDING A MAGNETIC ESCAPEMENT

(71) Applicant: THE SWATCH GROUP RESEARCH AND DEVELOPMENT LTD, Marin (CH)

(72) Inventors: Gianni Di Domenico, Neuchatel (CH); Pascal Winkler, Marin (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 15/109,066

(22) PCT Filed: Dec. 22, 2014

(86) PCT No.: PCT/EP2014/079036
§ 371 (c)(1),
(2) Date: Jun. 29, 2016

(87) PCT Pub. No.: WO2015/097172
PCT Pub. Date: Jul. 2, 2015

(65) Prior Publication Data

US 2016/0357155 A1 Dec. 8, 2016

(30) Foreign Application Priority Data

Dec. 23, 2013 (EP) ..... 13199427
Dec. 23, 2013 (EP) ..... 13199428
(Continued)

(51) Int. Cl.
*G04B 15/00* (2006.01)
*G04B 15/06* (2006.01)
(Continued)

(52) U.S. Cl.
CPC ..... *G04C 5/005* (2013.01); *G04B 15/00* (2013.01); *G04B 15/06* (2013.01); *G04B 17/04* (2013.01); *G04C 3/08* (2013.01); *G04B 17/06* (2013.01)

(58) Field of Classification Search
CPC ..... G04B 15/00; G04B 15/06; G04B 17/04; G04B 17/06; G04C 3/08; G04C 5/005
See application file for complete search history.

(56) References Cited

U.S. PATENT DOCUMENTS 3,410,083 A * 11/1968 Korr ..... G04C 5/005 368/126
3,518,464 A 6/1970 Kawakami et al.
(Continued)

FOREIGN PATENT DOCUMENTS

JP 52-40366 A 3/1977

OTHER PUBLICATIONS

International Search Report issued Nov. 23, 2015 in PCT/EP2014/079036 filed Dec. 22, 2014.

*Primary Examiner* — Vit W Miska
(74) *Attorney, Agent, or Firm* — Oblon, McClelland, Maier & Neustadt, L.L.P.

(57) ABSTRACT

There is provided a device for regulating the operation of a horological movement, including a magnetic escapement, which includes a resonator and a magnetic escapement mobile turning about an axis. The mobile includes at least one magnetic track with a plurality of magnets having an angular dimension that is greater than their radial dimension. The resonator includes at least one magnetic element for coupling to the magnetic track. The coupling element extends radially relative to the axis of rotation, and has a contour with a portion oriented substantially angularly when the resonator is in the rest position. When the mobile is driven in rotation, each magnet penetrates beneath the
(Continued)

coupling element and gradually accumulates some potential magnetic energy. The magnet then exits from beneath the coupling element through the portion and the coupling element receives a pulse located around its rest position.

33 Claims, 19 Drawing Sheets

(30) Foreign Application Priority Data

Jul. 11, 2014 (EP) ..... 14176816
Sep. 24, 2014 (EP) ..... 14186261

(51) Int. Cl.

| | |
|---|---|
| ***G04B 17/04*** | (2006.01) |
| ***G04B 17/06*** | (2006.01) |
| ***G04C 3/08*** | (2006.01) |
| ***G04C 5/00*** | (2006.01) |

(56) References Cited

U.S. PATENT DOCUMENTS

| | | | | | |
|---|---|---|---|---|---|
| 3,540,206 | A * | 11/1970 | Hetzel | ..... | G04B 11/04 368/128 |
| 3,727,396 | A * | 4/1973 | Hetzel | ..... | G04B 11/04 310/21 |
| 3,917,965 | A * | 11/1975 | Raval | ..... | G04B 11/04 310/21 |
| 2013/0279302 | A1 * | 10/2013 | Vardi | ..... | G04C 5/005 368/126 |

* cited by examiner

DEVICE INTENDED TO CONTROL THE ANGULAR SPEED OF A TRAIN IN A TIMEPIECE MOVEMENT AND INCLUDING A MAGNETIC ESCAPEMENT

TECHNICAL FIELD

The present invention relates to the field of devices for regulating the relative angular frequency between a magnetic structure and a resonator which are magnetically coupled so as to define together an oscillator. The regulating device of the present invention times the motion of a mechanical horological movement. More particularly, the invention relates to magnetic escapements for mechanical horological movements in which provision is made for direct magnetic coupling between a resonator and a magnetic structure. Generally, their function is to subject the rotational frequencies of the mobiles of a counter train of this type of horological movement to the resonant frequency of the resonator.

The regulating device therefore comprises a resonator, of which an oscillating portion is provided with at least one magnetic coupling element, and a magnetic escapement arranged so as to control the relative angular frequency between a magnetic structure forming said magnetic escapement and said resonator. It replaces the conventional balance wheel-spiral spring and the escapement mechanism, in particular the Swiss lever escapement and a toothed escapement wheel.

The resonator or the magnetic structure is rigidly connected in rotation to a mobile which is driven rotating with a determined torque which maintains an oscillation of the resonator. Generally the mobile is incorporated in a train or more generally a kinematic chain of a mechanism. This oscillation allows the relative angular frequency between the magnetic structure and the resonator to be regulated due to the magnetic coupling between them.

TECHNOLOGICAL BACKGROUND

Devices for regulating the speed of a wheel, also known as a rotor, by a magnetic coupling between a resonator and a magnetic wheel have been known for a number of years in the horological field. A number of patents relating to this field have been granted to Horstmann Clifford Magnetics for the inventions of C. F. Clifford. U.S. Pat. No. 2,946,183 in particular can be cited. The regulating device described in this document has various drawbacks, in particular an anisochronism problem (non-isochronism, in other words a lack of isochronism), specifically a significant variation in the pulsation (angular frequency) of the rotor depending on the torque applied to said rotor. This type of anisochronism results from anisochronism of the oscillator formed by the resonator and the magnetic wheel. The reasons for this anisochronism have already been included in the developments that lead to the present invention. These reasons will become clear later, on reading the description of the invention.

Magnetic escapements with a direct magnetic coupling between a resonator and a wheel formed by a disk are also known from Japanese patent application JPS 5240366 (application no. JP19750116941) and Japanese utility models JPS 5245468U (application no. JP19750132614U) and JPS 5263453U (application no. JP19750149018U). In the first two documents, provision is made to fill rectangular openings of a non-magnetic disk with a powder with high magnetic permeability or a magnetised material. Two adjacent coaxial annular tracks are thus obtained which each comprise rectangular magnetic zones arranged regularly with a given angular period, the zones of the first track being offset or shifted by half a period relative to the zones of the second track. There are therefore magnetic zones distributed alternately on both sides of a circle corresponding to the rest position (position zero) of the magnetic coupling element or component of the resonator. Said coupling element or component is produced by an open loop, depending on circumstances made of a material which is magnetised or has high magnetic permeability, between the ends of which passes the disk, which is driven rotating. The third document describes an alternative in which the magnetic zones of the disk are formed by small individual plates made of material with high magnetic permeability, the magnetic coupling element of the resonator thus being magnetised. The magnetic escapements described in these Japanese documents do not permit significant improvement of the isochronism, in particular for reasons that will be set out below with the aid of FIGS. 1 to 4.

FIG. 1 shows diagrammatically a regulating device or oscillator 2 of the prior art comprising a magnetic escapement of the type described in the above-mentioned Japanese documents. This device comprises a magnetic structure 4 and a resonator 6. The magnetic structure is supported by a mobile 8 made of a non-magnetic material on the surface of which two pluralities of axially magnetised rectangular magnets are arranged, the first and second pluralities of magnets 10 and 12 forming first and second annular magnetic tracks 11 and 13 respectively which are adjacent and concentric. Each of the two pluralities of magnets has the same number of magnets distributed at regular angles and defining the same angular period $\theta_P$, the first track being shifted by a half period (corresponding to a phase difference of 180°). The resonator 6 is shown symbolically by a spring 15, corresponding to its resilient deformation capacity defined by a resilient constant, and by inertia 16 (symbol 'I') defined by its mass and its structure. Said resonator comprises a magnet 18 of rectangular shape and defines an element for coupling to the magnetic structure. Said magnet has an axial magnetisation in the opposite direction to that of the magnets 10 and 12, such that it is arranged in repulsion of said magnets. It is capable of oscillating at a suitable frequency in a resonant mode where it has a radial oscillation relative to the axis of rotation 20 of the mobile 8 which is merged with the central axis of the annular magnetic structure. This resonant mode is excited and maintained when the magnetic structure 4 is driven rotating by a torque in a useful torque range, for example in an anticlockwise direction at angular frequency $\omega$ as shown in FIG. 1. Accordingly, the magnet 18 is situated above the mobile 8 such that its centre of mass is superimposed axially on an intermediate geometric circle defining a common limit or interface of the two concentric and contiguous annular tracks when the resonator is in the rest position.

As the magnets 10 and 12 form zones of magnetic interaction with the magnet 18 of the resonator and are situated alternately on both sides of the above-mentioned intermediate geometric circle, they define a sinuous (sinusoidal) magnetic path with a determined angular period $\theta_P$, which corresponds to the angular period of each of the first and second annular tracks 11 and 13. When the resonator is magnetically coupled to the magnetic structure driven rotating, the magnet 18 oscillates and follows said sinuous magnetic path and the angular frequency $\omega$ of the wheel is defined substantially by the oscillation frequency of the resonator. There is therefore a synchronisation between the frequency of the resonator and the rotational frequency or pulsation of the mobile 8. Here, synchronisation means a determined and constant relationship between two frequencies. The geometric shape of the magnet 18 will be observed, of which the active end portion (shown in FIG. 1) defines a rectangular surface in axial projection in the general geometric plane of the magnetic structure. In other words, said active end portion has a general average outer profile or contour, in a plane parallel to that of the magnetic structure, which is substantially rectangular. In this production of the prior art, the length of said rectangular surface is radial while its width, which is less than its length, is angular relative to the central axis of the annular magnetic structure or tangential relative to the above-mentioned intermediate geometric circle. In the example described here, said length is equal to about twice the width.

FIG. 2 shows diagrammatically, for a portion of the magnetic structure 4 and over a radial range corresponding to the width of the two magnetic tracks 11 and 13, the potential magnetic energy (also known as the potential magnetic interaction energy) of the oscillator 2 which varies angularly and radially. The level curves 22 correspond to different levels of potential magnetic energy. They define equipotential curves. The potential magnetic energy of the oscillator at a given point corresponds to a state of the oscillator when the magnetic coupling element of the resonator is located in a given position (its centre of mass or geometric centre being situated at said given point). It is defined to within a constant. Generally, the potential magnetic energy is defined relative to a reference energy which corresponds to the minimal potential energy of the oscillator. In the absence of any dissipative force, said potential energy corresponds to the work required to take the magnet from a position of minimal energy to a given position. In the case of the oscillator in question, said work is supplied by the torque applied to the mobile 8. The potential energy accumulated in the oscillator is transferred to the resonator when the coupling component of the resonator returns to a position of lower potential energy, in particular of minimal potential energy, by a radial movement relative to the axis of rotation of the mobile (in other words depending on the degree of freedom of the useful resonant mode). In the absence of any dissipative force, this potential energy is transformed into kinetic energy and resilient energy in the resonator by the work of the magnetic force between the coupling element of the resonator and the magnetic structure. Thus the torque supplied to the wheel serves to maintain the oscillation of the resonator which in return applies a braking force to the wheel regulating its angular frequency.

The outer annular track 11 defines an alternation of zones of low potential energy 24 and zones of high potential energy 26 whereas the inner annular track 13 defines, with an angular phase difference of half an angular period $\theta_P/2$ relative to the first track (in other words a phase difference of) 180°, an alternation of zones of low potential energy 28 and zones of high potential energy 30. The line 32 gives the position of the centre of the magnet 18 when the oscillator 2 is excited and the mobile 8 is therefore driven rotating with a determined torque. Said line illustrates the oscillation of the magnet of the resonator 6 in a system of reference linked to the mobile. As said magnet is in repulsion of the magnets of the magnetic structure 4, the zones of low potential energy correspond to the zones between the magnets of the magnetic structure whereas the zones of high potential energy correspond to the zones of said magnets, in other words to situations where the magnet 18 is at least in part superimposed on the magnets of the magnetic structure. It will be noted that in the case where the magnets are arranged in attraction, or alternatively in the case where the magnetic structure or the coupling component of the resonator is made of a ferromagnetic material, there is a spatial reversal between the zones of low potential energy and the zones of high potential energy compared with the case where the magnets are in repulsion.

Observing the level curves 22 of potential magnetic energy and oscillation 32, it will be seen that the oscillator accumulates potential magnetic energy at each alternation of the oscillation basically when the magnet 18 has reached its maximum amplitude and begins to return to its zero position. It can also be seen that the potential energy of the oscillator diminishes over a large part of each alternation. The force F applied to the magnet of the resonator is given by the potential magnetic energy gradient, which is perpendicular to the level curves 22. The angular component (degree of freedom of the magnetic structure) works by reaction on the wheel whereas the radial component (degree of freedom of the resonator) works on the coupling component of the resonator. The angular force corresponds on average to a braking force of the mobile because the angular reaction force is for the most part opposed to the direction of rotation of said mobile over a period of oscillation. The radial force corresponds to a thrust force on the oscillating structure of the resonator. It can be seen that the force F (see FIG. 2) has a radial component over a significant distance between the oscillation extrema 32. A thrust force therefore acts on the magnet of the resonator in the majority of each alternation.

If the potential energy curves 22 are analysed and the behaviour of the oscillator in question is studied in this case in relation to the torque applied to the wheel, at least two major drawbacks of such a regulating device can be observed. Firstly, the range of values for the torque is small and secondly the regulating device has significant anisochronism. Said anisochronism is so great in the prior art that it is not possible to produce a horological movement that has a suitable operating range, in other words with acceptable precision.

SUMMARY OF THE INVENTION

In the context of the present invention, after having noted the problems of anisochronism and limited operating range in the known regulating devices mentioned above, the inventors set themselves the objective of understanding the reasons and providing a solution to these problems.

Consideration of the problems of the prior art and of various research projects carried out allowed the causes of these problems to be defined. The problem of anisochronism and also that of the limited useful torque range are due in particular to the fact that a thrust force is applied to the magnet of the resonator over a relatively large radial distance between the positions corresponding to the extrema of its oscillation. Thus, the resonator is disturbed because a thrust force is applied to its oscillating component outside a zone located around its zero position (the rest position corresponding to minimal, generally zero, resilient energy, in the resonator). Only pulses provided at the zero position location of the oscillating component produce almost no disturbance of the oscillator. The inventors therefore noted that a thrust force over a relatively extensive path outside a zone located around the zero position disturbs the oscillator, which varies its frequency depending on the torque supplied, and therefore the oscillation amplitude, and is thus a source of anisochronism.

To resolve the anisochronism problem identified while allowing effective and stable operation of the oscillator over a relatively large torque range, the present invention proposes a device for regulating the relative angular frequency between a magnetic structure and a resonator, magnetically coupled so as to define together an oscillator forming said regulating device, as defined in claim 1 for a first main embodiment and in claim 11 for a second main embodiment.

In general, according to a first main embodiment, the regulating device according to the invention determines the relative angular frequency between a magnetic structure and a resonator magnetically coupled so as to define together an oscillator forming said regulating device, the magnetic structure comprising at least one annular magnetic track centred on the axis of rotation of said magnetic structure or of the resonator. The magnetic structure and the resonator are arranged to rotate in relation to one another about the axis of rotation when torque is applied to the magnetic structure or to the resonator. The resonator comprises at least one element for a magnetic coupling to the annular magnetic track, this magnetic coupling element having an active end portion made of a first magnetic material and situated on the same side as said magnetic track, said magnetic track being made at least in part of a second magnetic material arranged such that the potential magnetic energy of the oscillator varies angularly and periodically along the magnetic track, thus defining an angular period ($\theta_P$) of said magnetic track, and such that it defines magnetically first zones and second zones angularly alternating with a first zone and an adjacent second zone in each angular period.

Each second zone produces, relative to an adjacent first zone, a stronger repulsion force or a weaker attraction force for any same zone of said active end portion when said any same zone is superimposed, in orthogonal projection to a general geometric surface in which the annular magnetic track extends, respectively on said second zone or on said adjacent first zone. The magnetic coupling element is magnetically coupled to the magnetic track such that an oscillation by a degree of freedom of a resonant mode of the resonator is maintained within a useful range of a torque applied to the magnetic structure or to the resonator, and such that a period of said oscillation occurs during said relative rotation in each angular period of the annular magnetic track, the frequency of the oscillation thus determining the relative angular frequency. The degree of freedom defines an axis of oscillation of the active end portion passing through its centre of mass.

The resonator is arranged relative to the magnetic structure such that the active end portion is at least for the most part superimposed, in orthogonal projection to the general geometric surface, on said annular magnetic track during substantially a first alternation in each period of said oscillation, and such that the course taken by the magnetic coupling element during said first alternation is substantially parallel to the general geometric surface. In said general geometric surface, the annular magnetic track has a dimension along the orthogonal projection of the axis of oscillation which is greater than the dimension of the active end portion along said axis of oscillation. It will be noted that the axis of oscillation may be rectilinear or curvilinear.

The regulating device according to the first main embodiment is distinguished in particular by the combination of the following characteristics:

each of the two second zones has, in orthogonal projection in the general geometric surface of the annular magnetic track, a general contour with a first portion, defining a line of penetration above said second zone for the active end portion of the magnetic coupling element during said oscillation, and with a second portion defining an exit line above said second zone for said active end portion during said oscillation;

the exit line is oriented substantially in an angular direction parallel to a zero position circle centred on the axis of rotation and passing through the orthogonal projection, in the general geometric surface, of the centre of mass of the active end portion in the rest position of the coupling element;

the magnetic structure also defines for the active end portion at least one exit zone which extends in the general geometric surface, said at least one exit zone receiving, in orthogonal projection to said general geometric surface, at least the greater part of the active end portion when it exits, during said oscillation, successively from the annular magnetic track by the respective exit lines of the second zones, said at least one exit zone producing, relative to the second zones, a weaker repulsion force or a stronger attraction force for any same zone of the active end portion when said any same zone is superimposed, in orthogonal projection to general geometric surface, respectively on said at least one exit zone or on said second zones;

the active end portion of the coupling element in said rest position has, in orthogonal projection in the general geometric surface, a first dimension, along an axis perpendicular to the zero position circle and passing through the orthogonal projection of the centre of mass of said active end portion, and a second dimension, along a second axis defined by the zero position circle, which is greater than said first dimension; and the exit line of each of the second zones has a length, along said at least one exit zone and along said second axis, which is greater than the first dimension of the active end portion.

It will be noted that the first zones in a magnetic coupling in repulsion or the second zones in a magnetic coupling in attraction may be made of a non-magnetic material or of air. 'Magnetic material' means a material that has a magnetic property that produces an external magnetic field (magnet) or is a good conductor of the magnetic flux (in particular a material that is highly magnetically permeable, for example, a ferromagnetic material). 'Active end portion' means the end portion of the coupling element, situated on the same side as the magnetic structure in question, through which most of the magnetic coupling flux passes between said coupling element and the magnetic structure.

According to a first variant, the second dimension of the active end portion is at least twice as great as its first dimension. According to a second variant, the dimension of each of the second zones, along an axis perpendicular to said zero position circle at a mid-point of its exit line, is at least three times greater than the first dimension of the active end portion. According to a preferred variant, the exit line of each second zone is substantially merged with the zero position circle.

Where a projection is indicated in a surface, a superimposition (in particular 'above', 'beneath', 'opposite' or 'facing') or the expression 'in projection' or 'in orthogonal projection', it means an orthogonal projection in the surface in question, a superimposition in orthogonal projection to a geometric surface considered in the context or mentioned previously, or 'in orthogonal projection to such a geometric surface' respectively. This should be taken into consideration in the rest of the present description and in particular in the claims.

The invention also relates, according to a second main embodiment, to a regulating device which determines the relative angular frequency between a magnetic structure and a resonator magnetically coupled so as to define together an oscillator forming said regulating device, the magnetic structure comprising at least one annular magnetic track centred on an axis of rotation of said magnetic structure or of the resonator, the magnetic structure and the resonator being arranged to rotate in relation to one another about said axis of rotation when torque is applied to the magnetic structure or to the resonator. The resonator comprises at least one element for a magnetic coupling to the annular magnetic track, said coupling element having an active end portion made of a first magnetic material and situated on the same side as the annular magnetic track. Said annular magnetic track is made at least in part of a second magnetic material arranged such that the potential magnetic energy of the oscillator varies angularly and periodically along the annular magnetic track, thus defining an angular period ($\theta_P$) of said annular magnetic track. The magnetic coupling element is magnetically coupled to the annular magnetic track such that an oscillation by a degree of freedom of a resonant mode of the resonator is maintained within a useful range of a torque applied to the magnetic structure or to the resonator, and such that a period of said oscillation occurs during said relative rotation in each angular period of the annular magnetic track, the frequency of the oscillation thus determining the relative angular frequency. The degree of freedom defines an axis of oscillation of the active end portion that passes through its centre of mass.

The regulating device according to the second main embodiment is distinguished in particular by the combination of the following characteristics:

- the second magnetic material is arranged along the annular magnetic track such that it defines magnetically angularly alternating first zones and second zones with a first zone and an adjacent second zone in each angular period;
- in the useful torque range, the active end portion of the magnetic coupling element defines magnetically, in a general geometric surface in which said active end portion extends overall comprising the axis of oscillation, firstly an entry zone successively for the second zones in orthogonal projection to the general geometric surface, then a potential magnetic energy accumulation zone in the oscillator, which is angularly adjacent to the entry zone and into which each second zone penetrates in orthogonal projection at least in part from said entry zone, and finally an exit zone adjacent to the potential magnetic energy accumulation zone, said exit zone receiving in orthogonal projection at least the greater part of each second zone exiting from said accumulation zone or from a following second zone;
- each second zone produces per unit of angular length, relative to a first adjacent zone, a stronger repulsion force for the potential magnetic energy accumulation zone or a stronger attraction force for the entry zone and the exit zone;
- the potential magnetic energy accumulation zone produces, relative to the entry zone and the exit zone, a stronger repulsion force or a weaker attraction force for any same zone of each second zone when said any same zone is superimposed respectively on said potential magnetic energy accumulation zone, on the entry zone or on the exit zone;
- the annular magnetic track has, in orthogonal projection in the general geometric surface, a dimension along the axis of oscillation that is smaller than the dimension along said axis of oscillation of the active end portion;
- the resonator is arranged relative to the magnetic structure such that the potential magnetic energy accumulation zone is traversed in orthogonal projection by a median geometric circle, passing through the middle of the annular magnetic track, substantially during a given alternation in each period of said oscillation;
- the potential magnetic energy accumulation zone has a general contour with a first portion, defining a line of penetration beneath said accumulation zone successively for each of the second zones during said oscillation, and with a second portion defining an exit line from beneath said accumulation zone for said second zone or a following second zone during said oscillation;
- the exit line is oriented, when the magnetic coupling element is in its rest position, substantially in an angular direction parallel to the orthogonal projection of the median geometric circle of the annular magnetic track;
- each of the second zones has in orthogonal projection, when the centre of said second zone is superimposed on the axis of oscillation, a first dimension, along a first axis perpendicular to the orthogonal projection of the median geometric circle and passing through the point of intersection of said orthogonal projection of the median geometric circle with the axis of oscillation, and a second dimension, along a second axis perpendicular to the first axis and passing through the above-mentioned point of intersection, which is greater than the first dimension; and
- when the magnetic coupling element is in its rest position, the exit line has a length, along the exit zone and along the above-mentioned second axis, which is greater than the first dimension of the second zones.

It will be noted that either the potential magnetic energy accumulation zone in a magnetic coupling in attraction, or the entry zone and the exit zone in a magnetic coupling in repulsion can be defined by a non-magnetic material rigidly connected to the coupling element or may correspond to regions of air at the periphery of the active end portion of the coupling element. It will then also be noted that the first zones (coupling in repulsion) or the second zones (coupling in attraction) may be made of a non-magnetic material or of air.

'General contour of a zone' means, when said zone is completely delimited, an average line defining the general profile of its periphery or, when said zone is open and thus only partly delimited, an average line defining the general profile of the limit of said zone relative to the magnetic coupling element in question.

According to a preferred variant, the exit line from the potential magnetic energy accumulation zone merges substantially, in orthogonal projection to the general geometric surface, with the median geometric circle when the coupling element is in the rest position.

According to a first variant, the second dimension of each second zone is at least twice as great as its first dimension. According to a second variant, the length of the line of penetration of the potential magnetic energy accumulation zone along the axis of oscillation is at least five times greater than the dimension of the annular magnetic track along said axis of oscillation in orthogonal projection in the general geometric surface.

According to a first main variant, the general geometric surface is a plane perpendicular to the axis of rotation, the degree of freedom being substantially parallel to said plane.

According to a second main variant, the general geometric surface is a cylindrical surface having as its central axis the axis of rotation, the degree of freedom being substantially oriented along said axis of rotation.

According to a particular embodiment, the regulating device forms an oscillator with a magnetic cylinder escapement. In general, said regulating device is characterised in that an active end portion of the coupling element is formed substantially by a truncated cylindrical tube section and has a central axis merged with an axis of rotation of the resonator, the degree of freedom thereof being angular and the axis of oscillation being circular. Said truncated cylindrical tube section defines a truncated annular surface in the general geometric surface, corresponding to said potential magnetic energy accumulation zone in the two alternations successively of each period of oscillation. Said truncated annular surface has a first end and a second end, as well as an outer contour defining a first circular line of penetration and an inner contour defining a second circular line of penetration. The first end defines a first exit line, and the second end defines a second exit line having similar characteristics to the first exit line. The outer contour is associated with the first exit line in a first alternation of the period of oscillations of the resonator in order to provide magnetic coupling successively with the second zones of the magnetic track and produce a first pulse at the end of each first alternation, whereas the inner contour is associated with the second exit line, in order to provide magnetic coupling successively with said second zones in the second alternation of the period of oscillations and to produce a second pulse at the end of each second alternation.

Other particular characteristics of the invention will be set out below in the detailed description of various embodiments and variants of the invention.

BRIEF DESCRIPTION OF THE DRAWINGS

The invention will be described below with reference to the accompanying drawings, given as examples which are in no way limiting, in which.

DETAILED DESCRIPTION OF THE INVENTION

Figure 1:
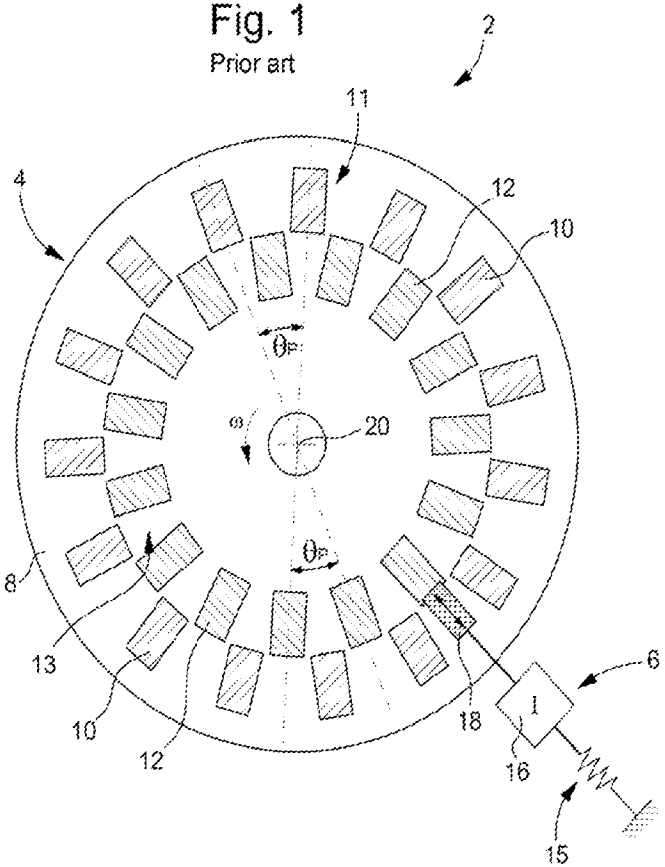
Fig. 1 Prior art
FIG. 1, already described, is a plan view of a horological oscillator of the prior art.

With reference to FIGS. 3 to 6, a first main embodiment of the invention will be described below. The regulating device 36 of FIG. 3 determines the relative angular frequency $\omega$ between the magnetic structure 4 and a resonator 38 which are magnetically coupled so as to define together a horological oscillator forming said regulating device. The magnetic structure 4 is rigidly connected to a mobile with an axis of rotation 20. It is similar to the magnetic structure of FIG. 1 and comprises a first annular magnetic track and a second annular magnetic track which are contiguous and centred on the axis of rotation 20. The magnetic structure and the resonator are arranged to rotate relative to one another when a torque is applied to the magnetic structure or to the resonator. In the example shown, the resonator is rigidly connected to the horological movement whereas the magnetic structure is arranged pivoting and defines a magnetic escapement wheel. The resonator comprises a coupling element magnetically coupled to the annular magnetic tracks 11 and 13, said coupling element having an active end portion 46 made of a first magnetic material and situated on the same side as said magnetic structure. Each magnetic track is made in part of a second magnetic material arranged such that the potential magnetic energy of the oscillator varies angularly and periodically along said annular magnetic track, thus defining the same angular period ($\theta_P$) for the two magnetic tracks.

More particularly, each magnetic track is formed by first zones 40, 42 respectively and second zones 10, 12 respectively which alternate angularly with a first zone and an adjacent second zone in each angular period. In general, each second zone produces, relative to a first adjacent zone, a stronger repulsion force (in the case of a magnetic coupling in repulsion between the end portion 46 and the magnetic tracks 11 and 13, as is the case in the examples in FIG. 3 to 6) or a weaker attraction force (in the case of a magnetic coupling in attraction in a variant where either the coupled magnets are arranged in attraction, or the active end portion or the magnetic tracks is/are made of a highly magnetically permeable material with no magnetic flux generator) for any same zone 50 of the active end portion 46, when said any same zone is superimposed, in orthogonal projection to a general geometric surface in which the annular magnetic track extends, on said second zone, or on said first adjacent zone respectively. The general geometric surface is in this case a general plane of the magnetic structure perpendicular to the axis of rotation 20. In the variant in FIG. 3, the second zones 10 and 12 are rectangular and the first zones are trapezium-shaped.

The magnetic coupling element is magnetically coupled to each annular magnetic track, via the active end portion 46, such that an oscillation by a degree of freedom of a resonant mode of the resonator is maintained within a useful torque range applied to the magnetic structure or to the resonator, and such that a period of said oscillation occurs during the relative rotation between the resonator and the magnetic structure in each angular period $\theta_P$ of each annular magnetic track. The frequency of said oscillation thus determines the relative angular frequency $\omega$. The degree of freedom is linear in the diagrammatic examples in FIGS. 3 and 5, and defines an axis of oscillation 48 of the active end portion 46 passing through the centre of mass of said active end portion. Said axis of oscillation has in this case a radial direction relative to the axis of rotation 20. It will be noted that when the degree of freedom follows a curve, in particular when said degree of freedom is a rotation about a given axis, the axis of oscillation is curvilinear, in particular circular. The first main embodiment is characterised in that the annular magnetic tracks each have a dimension along the degree of freedom, in other words along an orthogonal projection of the axis of oscillation 48 in the general plane of the magnetic tracks, which is greater than the dimension of the active end portion 46 along said degree of freedom, in other words along the axis of oscillation.

Each of the second zones 10, 12 of each annular magnetic track has in orthogonal projection a general contour with a first portion, defining a line of penetration 10*a*, 12*a* above said second zone for the active end portion 46 exiting from the first adjacent zone 40, 42 during oscillation of said active end portion, and a second portion defining an exit line 10*b*, 12*b* above said second zone for at least a greater part of said active end portion passing directly from said second zone to an exit zone 42, 40 during said oscillation. Said exit zone is defined by the magnetic structure and extends in the general plane of the magnetic tracks. In the examples given in the figures with two magnetic tracks in the general geometric surface, the entry zones 40, 42 of a magnetic track, defined by the first zones of said track, correspond to the exit zones for the other magnetic track. In an embodiment with a single magnetic track coupled to the active end portion 46, there may be a single annular exit zone for all the second zones. Thus, there is at least one exit zone receiving in orthogonal projection the active end portion when said active end portion exits during oscillation thereof, successively from an annular magnetic track by the respective exit lines of said second zones.

In general, the exit zones or the annular exit zone are/is arranged so as to produce, relative to the second zones, a weaker repulsion force or a stronger attraction force for any same zone 50 of the active end portion when said any same zone is superimposed in orthogonal projection on said exit zone(s), or respectively on said second zones. This condition is fulfilled when the entry zones and the exit zones are both defined by the first zones of the two magnetic tracks coupled to the active end portion, as is the case in FIGS. 3 and 5.

According to the invention, each exit line is oriented substantially in an angular direction parallel to a zero position circle 44 which is centred on the axis of rotation 20 and passes through a projection of the centre of mass of the active end portion 46 in the general geometric surface when said active end portion is in the rest position (the position in which the resilient energy of the resonator is minimal and about which it oscillates). FIG. 3A shows the orthogonal projection 54 of the active end portion in the rest position. As mentioned, the angular direction gives substantially the orientation of the exit line of each second zone, which encompasses in particular the directions tangential to the zero position circle 44 for the portion of said circle situated in an angular sector defined by said second zone. In the variant in FIG. 3, the exit line is parallel to the tangent to the circle 44 at the point of intersection with a radial straight line passing through the mid-point of said exit line.

The active end portion 46 of the coupling element in the rest position has, in orthogonal projection in the general plane of the magnetic tracks, a first dimension W2 along a first axis in said general plane which is perpendicular to the zero position circle 44 and passes through the orthogonal projection of the centre of mass of said active end portion. In the variants shown in FIGS. 3 and 5, said first axis is rectilinear and merged with an orthogonal projection of the axis of oscillation 48 in the general plane, and has a radial direction relative to the axis of rotation 20. Next, the orthogonal projection of the active end portion 46 has a second dimension L2, along a second axis defined by the zero position circle, which is greater than the first dimension W2. Here, a dimension is understood to be along a circular axis merged with the zero position circle or along a rectilinear axis tangent to said circle at the point of intersection with the orthogonal projection of the axis of oscillation, in other words at the point determined by the orthogonal projection of the centre of mass of the portion 46, and perpendicular to the first axis. Moreover, the exit line of each of the second zones 10, 12 has a length L1, along said at least one exit zone and along the second axis defined by the zero position circle, which is greater than the first dimension W2 of the active end portion 46. In the case of the circular axis, the angular position of the second zone in question is of no importance. However, if the tangential axis is chosen, the length L1 of a second zone is measured along said tangential axis when the mid-point of said length is positioned on the first axis. In a particular variant, the second dimension L2 of the active end portion is at least twice as great as its first dimension W2, and the length L1 of the exit line is at least twice as great as said first dimension W2. In the example in FIG. 3, the length to width ratio of the end portion 46 is equal to about three.

The resonator is arranged relative to the magnetic structure such that the active end portion is at least for the most part superimposed on said annular magnetic track during substantially a first alternation in each period of oscillation of said active end portion, and such that the course taken by the magnetic coupling element during said first alternation is substantially parallel to the general geometric surface. This condition can be regarded as generally verified when the zone of orthogonal projection 54 of the active end portion according to the invention, in the rest position, is traversed by the inner circle of the outer magnetic track 11 and the outer circle of the inner magnetic track 13. It will be noted that said two circles are merged when the two magnetic tracks are contiguous, as is substantially the case in the preferred variants of the invention. They therefore define an interface circle of the two tracks. Preferably, the zero position circle 44 is substantially merged with the interface circle of the two magnetic tracks.

Figure 3:
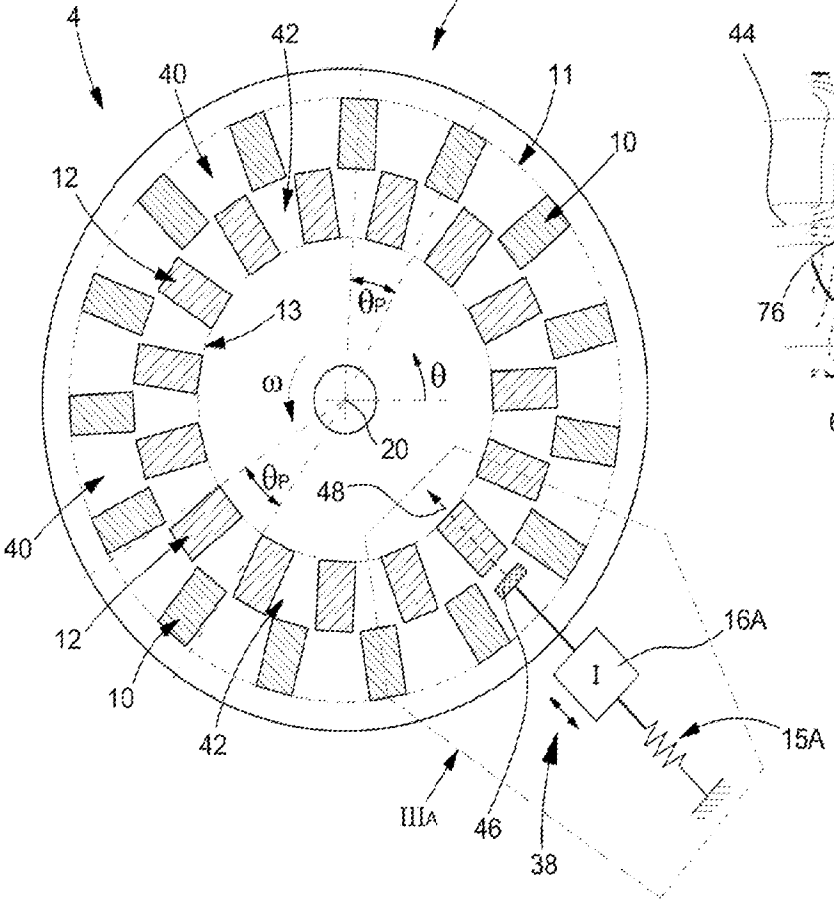
FIGS. 3 and 3A are diagrammatic plan views of a first main embodiment of the invention.
Figure 5A:
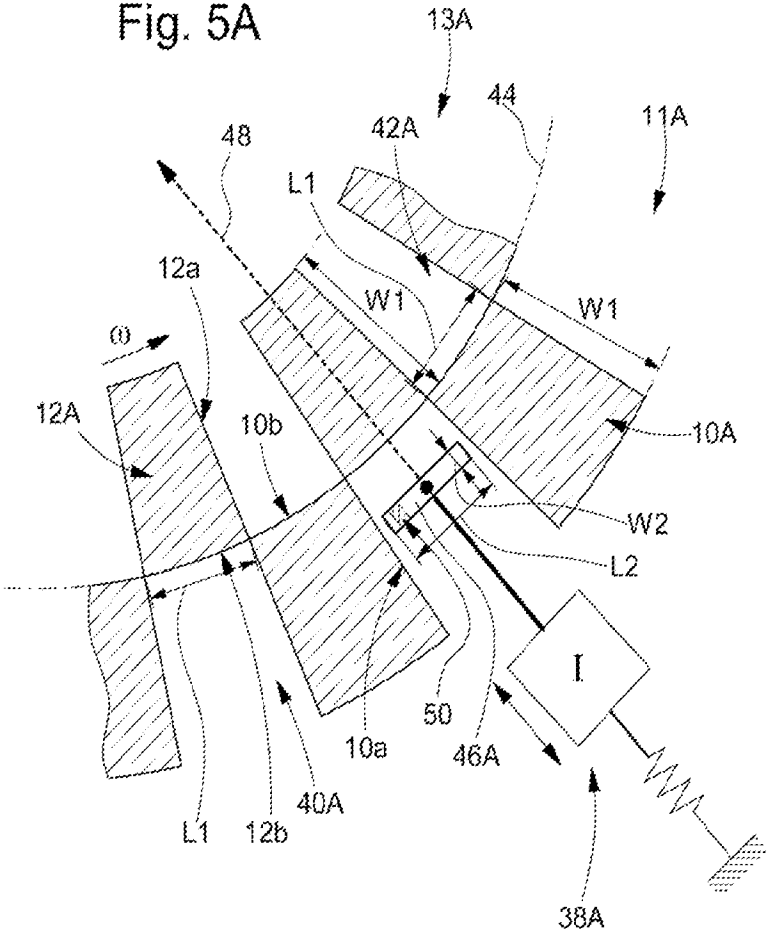
FIGS. 5 and 5A are diagrammatic plan views of a first variant of the first main embodiment.
Figure 3A:
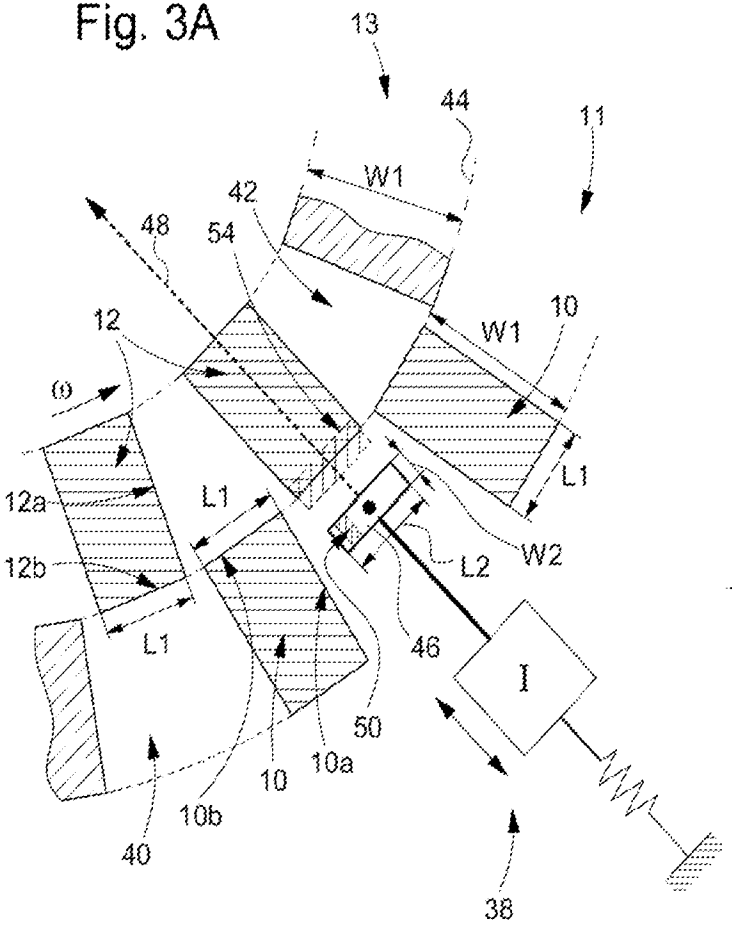
Figure 5:
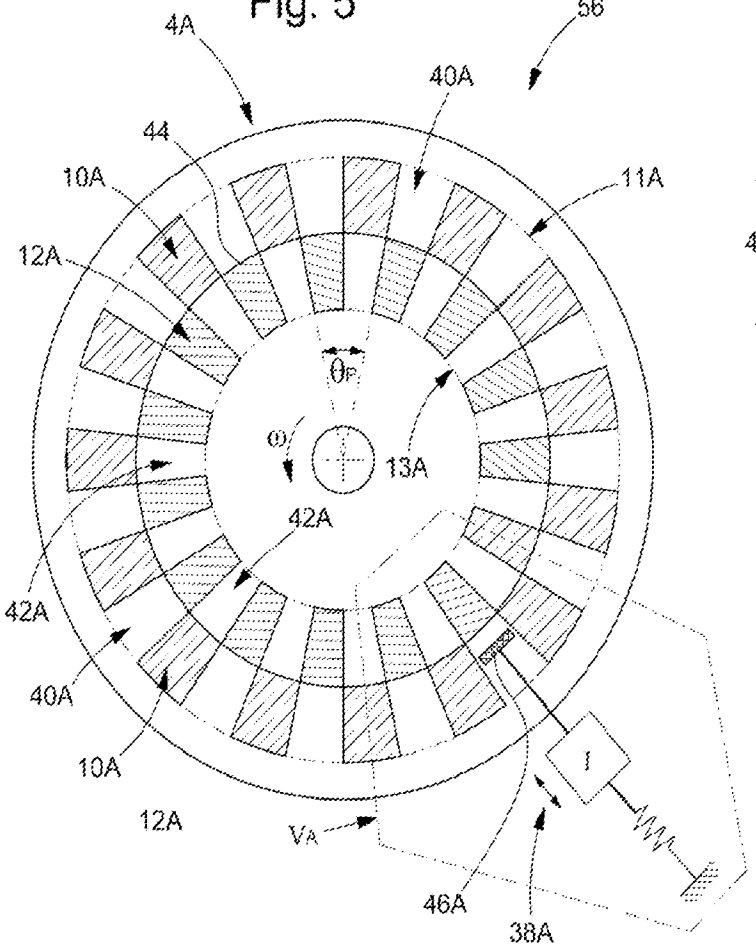

In a preferred variant, the exit line of each second zone 10, 12 is substantially merged with the zero position circle, as is the case in the variants in FIGS. 3 and 5. In another variant where the two magnetic tracks are distant and separated by an intermediate zone formed by a homogeneous magnetic medium, the zero position circle is situated between said two tracks, preferably substantially in the middle of the intermediate zone. Such an intermediate zone, which will be kept of small width for various reasons, may be useful to ensure easy starting of the oscillator. A first reason relates to the small dimension provided for the active end portion of the coupling element along the axis of oscillation, given that there is a need to avoid the oscillator turning 'unloaded' with said active end portion remaining substantially on the zero position circle. Another reason relates to an object of the present invention, which is to obtain localised pulses that are close to and preferably substantially centred on, the zero position circle. The condition discussed here is also verified in that the width of the intermediate zone is much smaller than the width of each magnetic track, which is the case in the context of the invention.

According to a preferred variant, the zero position circle 44 and the axis of oscillation 48 are, in orthogonal projection to the general geometric surface, substantially orthogonal at their point of intersection. This is the case in the variants shown in FIGS. 3 and 5.

According to another variant, the dimension W1 of each of the second zones, along an axis perpendicular to the zero position circle at a mid point of its exit line, is at least three times as great as the first dimension W2 of the active end portion. In another preferred variant, said dimension of the second zones is at least six times greater than the first dimension of the active end portion.

The variant in FIGS. 5 and 5A is distinguished from that in FIG. 3 firstly by the fact that the second zones 10A and 12A as well as the first zones 40A and 42A of the annular tracks 11A and 13A define annular sectors. It will be observed that, in the variant in FIG. 5, the zero position circle 44 is merged, in orthogonal projection in the general plane of the magnetic structure 4A, with the exit lines 10*b*, 12*b*. Said exit lines therefore have an angular direction and the lines of penetration 10*a*, 12*a* are radial. Next, the variant in FIG. 5 is distinguished by the dimensions W2 and L2 of the active end portion 46A of the coupling element of the resonator 38A. In a preferred variant, the second dimension L2 of the active end portion is at least four times greater than its first dimension W2, and the length L1 of the exit line is at least four times greater than said first dimension. In the variant in FIG. 5, the length to width ratio of the end portion 46A is equal to about five.

In FIG. 5, the line of penetration 10*a*, 12*a* of each second zone is oriented along the axis of oscillation 48, projected orthogonally in the general plane of the magnetic tracks, when said line of penetration is aligned with the centre of mass of the active end portion 46A projected orthogonally in said general plane. In the variant in FIG. 3, this is substantially the case. It will also be observed that the exit line of the second zones, along the exit zones defined by the second zones of the other magnetic track, and the active end portion extend angularly over half an angular period $\theta_P/2$ in FIG. 5, and this is approximately the case in FIG. 3.

In the variants set out above, the degree of freedom of the resonator is entirely in a plane parallel to the general plane of the magnetic tracks and therefore of the magnetic structure. Thus, the entire course taken by the magnetic coupling element during its oscillation is, in said variants, parallel to the general plane of the magnetic structure. It will be noted that other arrangements can be envisaged, of the magnetic tracks for example, the general geometric surface of which is cylindrical or truncated. Generally, the course of the oscillating element is substantially parallel to the general geometric surface defined by the magnetic structure. However, it will be observed that said course, and therefore the axis of oscillation, may diverge somewhat from a surface parallel to the general geometric surface, in particular at the end points of the oscillation, especially if the amplitude is great. Such a situation takes place for example when the coupling element of the resonator oscillates along a substantially circular course with an axis of rotation parallel to the general plane of the magnetic structure. In such a case, provision is made preferably for the direction defined by the degree of freedom of the coupling element in the rest position to be parallel to a plane tangent to said general geometric surface at a point corresponding to the orthogonal projection of the centre of mass of the active end portion of the coupling element in the rest position.

Figure 2:
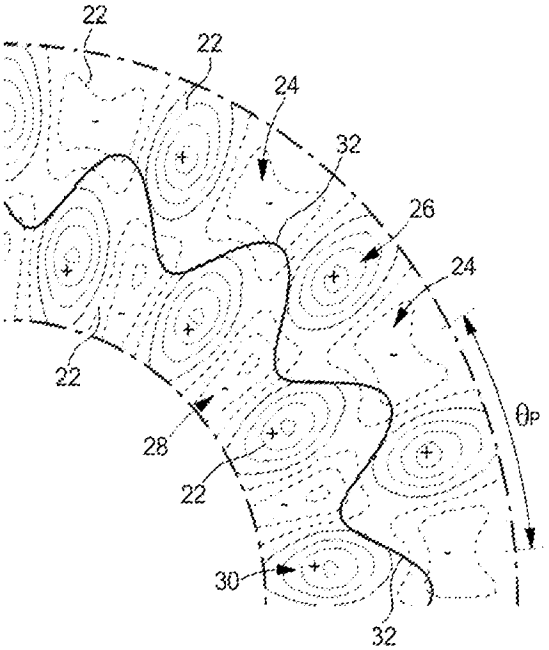
Fig. 2 Prior art
FIG. 2, already described, shows the potential magnetic energy in the oscillator of FIG. 1.
Figure 4:
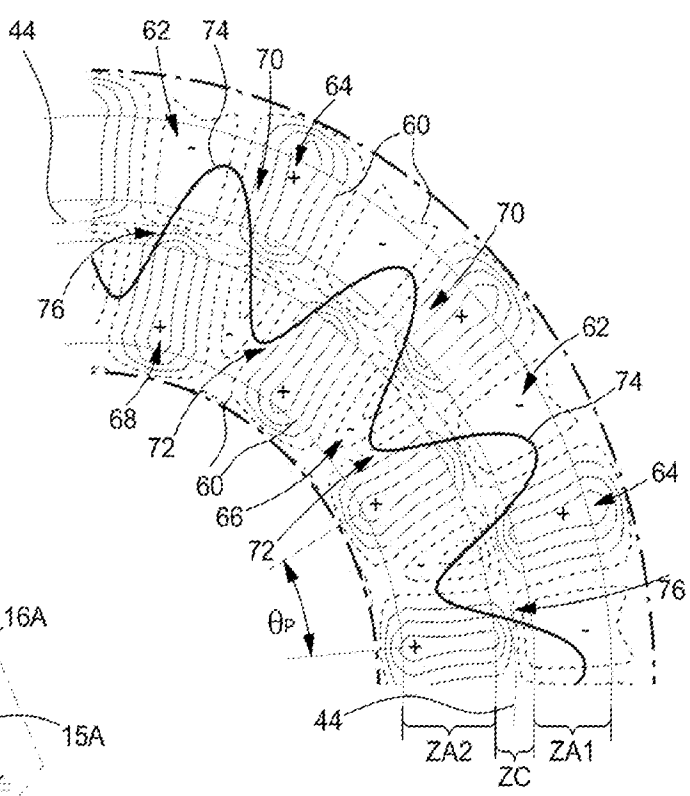
FIGS. 4, 6 and 8 show the potential magnetic energy in the oscillators of FIGS. 3, 5 and 7 respectively.

FIG. 4 shows, in a way similar to FIG. 2, the potential magnetic energy of the oscillator depending on the relative position of the active end portion 46 and of the magnetic structure 4, in particular of each of its two magnetic tracks. Said relative position is defined by the relative angular position in a system of reference linked to the magnetic tracks and by the position of the end portion along the axis of oscillation 48. The equipotential lines 60 are given for relative positions corresponding to the two magnetic tracks. It can clearly be seen that this is very different from the distribution of the potential magnetic energy in FIG. 2. For each of the magnetic tracks, there is a sector 70, 72 of potential magnetic energy accumulation in the oscillator between each zone of low potential energy 62, 66 and a following high potential energy zone 64, 68, said sector being well defined and extending angularly over a determined and relatively wide range, specifically about a half period for the inner magnetic track 13 and slightly less for the outer magnetic track 11 of greater diameter. Said sectors 70 and 72 define respectively two annular potential magnetic energy accumulation zones ZA1 and ZA2 in which the equipotential curves are substantially radial. Thus, in said two annular zones, the force is basically tangential and therefore corresponds to a braking force for the magnetic structure 4. However, in said annular zones ZA1 and ZA2, the force applied to the coupling element depending on its degree of freedom is low or virtually zero.

Next, it can be seen that the equipotential lines 60 become substantially angular in a central zone ZC inside which the coupling component of the resonator receives a pulse along the axis of oscillation. The outline of an oscillation 74 of the active end portion 46 has been shown in a system of reference linked to the magnetic structure. By following said outline, it can be seen that most of the time the oscillation is substantially free and that a pulse is supplied at each alternation in the central pulse zone ZC. Said central zone ZC is situated between the two annular zones ZA1 and ZA2 and comprises the zero position circle 44, more precisely the relative positions corresponding to said zero position circle which is situated substantially in the middle of said central zone ZC. Thus, the pulses are produced around the rest position of the active end portion. The observations relating to the potential magnetic energy in the oscillator help demonstrate that the regulating device according to the invention significantly overcomes the problem associated with the anisochronism of the devices of the prior art.

In general, in the useful torque range applied to the horological oscillator of the invention, each annular magnetic track, at least one exit zone as previously described and the magnetic coupling element define in each angular period, depending on the relative position of said annular magnetic track and of the active end portion (in a system of reference linked to the magnetic track), an accumulation sector 70, 72 in which the oscillator basically accumulates potential magnetic energy and a pulse sector 76, adjacent to said accumulation sector, in which the magnetic coupling element basically receives a pulse, the pulse sectors being situated in a central pulse zone ZC comprising the zero position circle 44. Thus, 'accumulation sector' means a sector in which the potential magnetic energy in the oscillator increases for the various oscillation amplitudes in the useful torque range and where the radial force is weak or negligible; and 'pulse sector' means a sector in which said potential magnetic energy reduces for the various oscillation amplitudes of the useful torque range and where a thrust force is applied to the coupling component of the resonator depending on its degree of freedom, producing a pulse supplied to said coupling component.

In general, the magnetic structure is arranged such that the average angular gradient of the potential magnetic energy of the oscillator in the potential magnetic energy accumulation sectors is less than the average gradient of said potential magnetic energy in the pulse sectors, depending on the degree of freedom of the coupling element of the resonator, and in the same unit. This condition can be seen clearly in FIG. 4 and results from the characteristics of the invention. The relatively large angular extent of the accumulation sectors and the relatively small radial distance of the pulse sectors results in particular from the first and second dimensions W2 and L2 of the active end portion as well as the orientations of the lines of penetration and of the exit lines of the potential magnetic energy accumulation zones. In each alternation of the oscillation of the coupling element when its active end portion is magnetically coupled to an annular magnetic track, said end portion penetrates gradually above (or beneath) a potential magnetic energy accumulation zone. In view of the contour and orientation of said active end portion and the contour of the accumulation zones, there is a superimposition surface between the active end portion and each accumulation zone which increases gradually over a relatively large angular period, whereas the exit from such an accumulation zone takes place over a relatively short radial distance, along the axis of oscillation respectively. This will be explained again later in the context of the second main embodiment of the invention.

It will be noted that in the horological field, the torque supplied by a barrel varies significantly depending on the degree of tension of the barrel spring. To provide a horological movement that operates for a sufficiently long period, it is usually necessary for said movement to be able to be driven by a torque that varies between a maximum and about a half of said maximum torque. Moreover, there is clearly a need to ensure reliable operation at maximum torque. In practice, to provide such operation and in particular to ensure that the oscillator does not uncouple at relatively large oscillation amplitude, the braking sectors must extend over a determined angular distance and braking is therefore gradual. This is one of the advantages obtained by the regulating device according to the invention.

Figure 6:
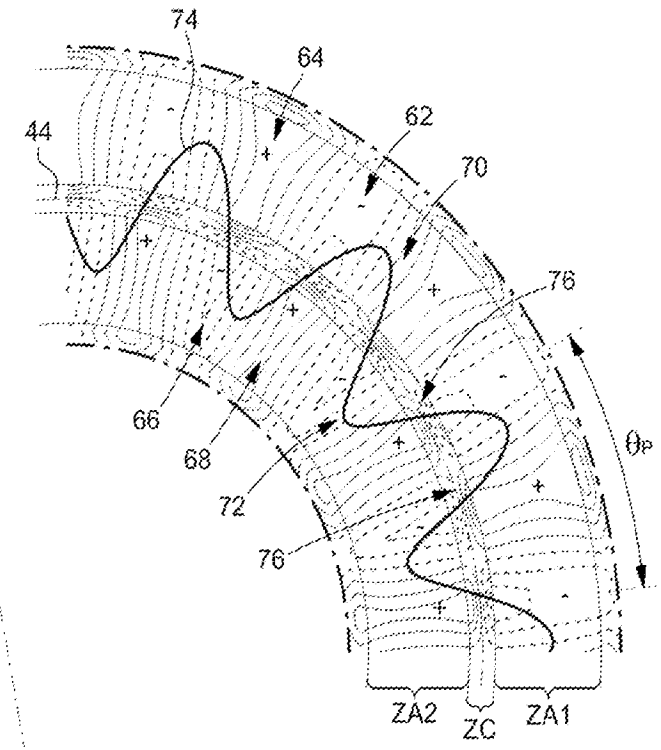

FIG. 6 shows the potential magnetic energy in the oscillator of FIG. 5. The various references will not be described again here. It can be seen that the radial dimension of the annular accumulation tracks ZA1 and ZA2 is greater than that obtained for the variant in FIG. 3, whereas the radial width of the pulse zones and therefore of the central pulse zone ZC is smaller. Said variant of FIG. 5 is more advantageous than that of FIG. 3 as the location of the pulses around the rest position of the coupling element of the resonator is better. This results firstly from the length to width ratio of the active end portion which is greater in the variant in FIG. 5.

Referring to FIGS. 7 to 10, a second main embodiment of the invention will be described below. Various teachings given previously also apply to this second embodiment. They will therefore not be repeated in detail here. In this second embodiment, the annular magnetic track of the magnetic structure has a dimension, along the axis of oscillation of each active end portion coupled to said track and in orthogonal projection, that is smaller than the dimension along said axis of oscillation of said active end portion. Said second embodiment constitutes to some extent a technical reversal of the first embodiment. However, it has its own advantages, as will become clear later. This second embodiment is not immediately obvious in the light of the previous embodiments, as persons skilled in the art will normally have provided magnetic segments extending radially over an escapement wheel and magnetic coupling elements of lesser extent associated with the resonator. In these previous embodiments, the sinuous (sinusoidal) magnetic path is arranged in a circular manner on a mobile. If there are two annular magnetic tracks to produce said sinusoidal magnetic path, they are arranged coaxially. In the most common embodiment, as in the variants in FIGS. 3 and 5, said two tracks extend in a general plane with an inner track and an outer track. Said two tracks therefore do not have the same dimensions, the inner track having at least some zones that are smaller relative to the corresponding zones of the outer track, whereas the dimensions of the coupling element are by definition constant. There is therefore a magnetic interaction that varies to some extent between the two magnetic tracks and in the two alternations of each period of oscillation. The second main embodiment overcomes this drawback in a surprising way by arranging at least one extended magnetic segment in the region of the coupling element of the resonator, whereas the magnetic track is radially diminished and not as wide as said coupling segment. Thus, the sinusoidal magnetic track is no longer defined by the escapement wheel, but by one or preferably two coupling elements rigidly connected to an oscillating structure of the resonator.

Figure 7:
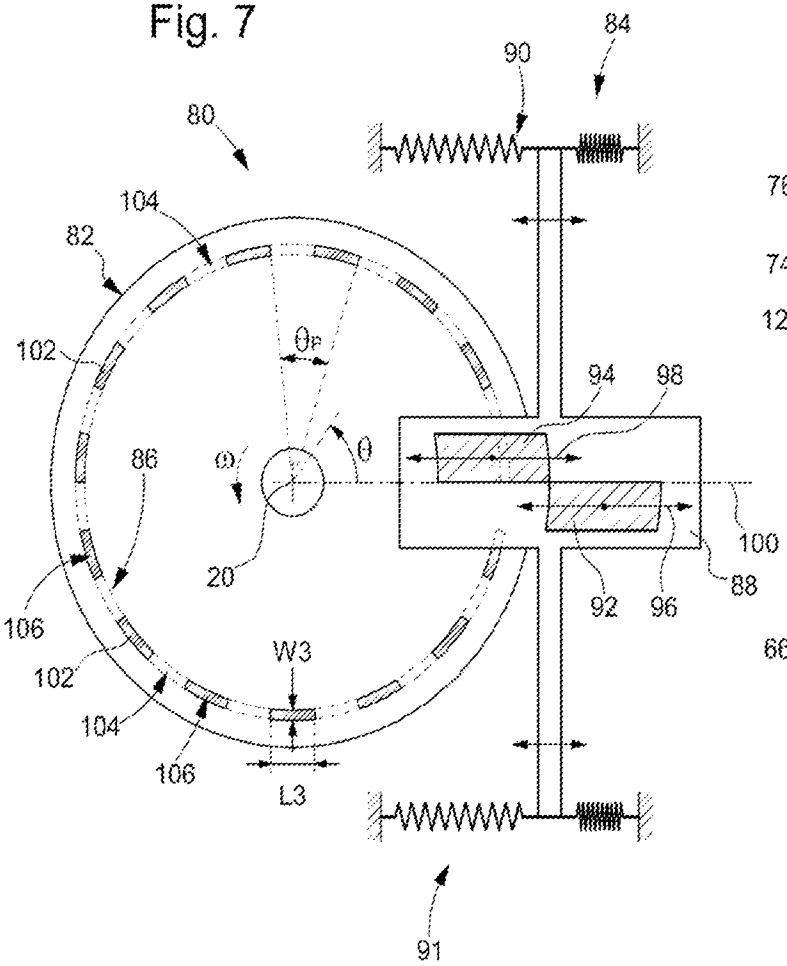
FIG. 7 is a diagrammatic plan view of a second main embodiment of the invention.

The device 80 for regulating the angular frequency ω of an escapement mobile comprises a magnetic structure 82 rigidly connected to said mobile and a resonator 84 magnetically coupled so as to define together an oscillator. The magnetic structure comprises an annular magnetic track 86 centred on the axis of rotation 20. The magnetic structure and the resonator are arranged to rotate relative to one another about the axis of rotation 20 when torque is applied to the escapement mobile and thus to the magnetic structure. The resonator is shown diagrammatically. It comprises two elements for magnetic coupling to the magnetic track which are arranged on a non-magnetic support 88, which has two arms associated respectively with two identical resilient structures 90 and 91 allowing a linear oscillation of the support 88 along a radial straight line 100. The coupling elements are formed in the variant described here by two elongate magnets which have first and second active end portions 92 and 94 respectively situated on the side of the magnetic track 86, said magnets having an overall direction of magnetisation along the axis of rotation (axial direction of magnetisation). In FIG. 7, as in the other figures, the general contour of said active end portions has been shown in their general plane, as their configuration is important for the invention. The degree of freedom of the resonator defines a first axis of oscillation 96 and a second axis of oscillation 98 for the two active end portions respectively passing through their centre of mass. Said first and second axes of oscillation are parallel to a central axis 100 passing longitudinally between the two active end portions, said central axis being provided radially, in other words intercepting the axis of rotation 20.

The magnetic track 86 comprises a plurality of angularly elongate magnets 102, which are arranged along said magnetic track such that they define first non-magnetic zones 104 and second magnetic zones 106 angularly alternating with a first zone and an adjacent second zone in each angular period $\theta_P$, which is defined by the alternation of the first non-magnetic zones and the second magnetised zones. The coupling elements are magnetically coupled to the magnetic track 86 such that an oscillation depending on the degree of freedom of the useful resonant mode of the resonator 84 is maintained within a useful torque range applied to the magnetic structure, and such that a period of said oscillation occurs during a rotation of the magnetic structure, resulting from said torque, in each angular period $\theta_P$ of the magnetic track. In the variant described in FIGS. 7 to 10, the magnets 102 are arranged with an axial direction of magnetisation, in repulsion of the magnets forming the coupling elements.

It will be noted that, in the second main embodiment, the determining general geometric surface is considered to be the surface in which the active end portions of the resonator coupled to the annular magnetic track in question and comprising their respective axes of oscillation extend overall, said active end portions defining magnetic segments in said surface. FIG. 10 shows, in orthogonal projection in the general plane of the active end portions 92 and 94, the relative movement between the annular magnetic track and said active end portions in the course of a period of oscillation during which the magnetic track 86 turns through an angular period. Thus, said FIG. 10 shows a succession of images a) to i) which follow the oscillating movement of a magnet 102A, from among the magnets 102 of the magnetic track 86. For ease of understanding, said images are given in a system of reference linked to the support 88 of the resonator and therefore to the coupling elements. Thus, the magnet 102A of the magnetic track in particular can be seen, which oscillates with its centre of mass describing a substantially sinusoidal curve 122, whereas in reality, the magnetic track only rotates, and it is the active end portions that oscillate along their linear axis of oscillation. To indicate this, magnetic segments, defined by the orthogonal projection of the active end portions (hereinafter also referred to as magnetic segments 92 and 94) have been shown with arrows indicating the direction of the oscillation movement and the displacement speed indicated approximately by the length of said arrows, the absence of an arrow corresponding to an extreme position where there is a reversal of the direction of linear movement of the coupling elements. Next, the magnets of the magnetic track are projected in the general plane and are not shown as passing beneath the two coupling elements. In said FIG. 10 (drawings 10*a* to 10*i*), it can be seen that the magnet 102A is located initially upstream of the magnetic segment 92 (drawing 10*a*), before penetrating gradually into said segment 92 (drawings 10*b*-10*c*) to then exit therefrom (drawing 10*d*) and be magnetically coupled in a similar way with the magnetic segment 94 (drawings 10*e*-10*g*). Finally, the magnet 102A exits from the magnetic segment 94 (drawing 10*h*) while a following magnet 102 is placed in front of the segment 92, thus corresponding to the situation in drawing 10*a* for said following magnet 102, which will in turn be subject to the same magnetic coupling with the two coupling elements of the resonator.

Figure 9:
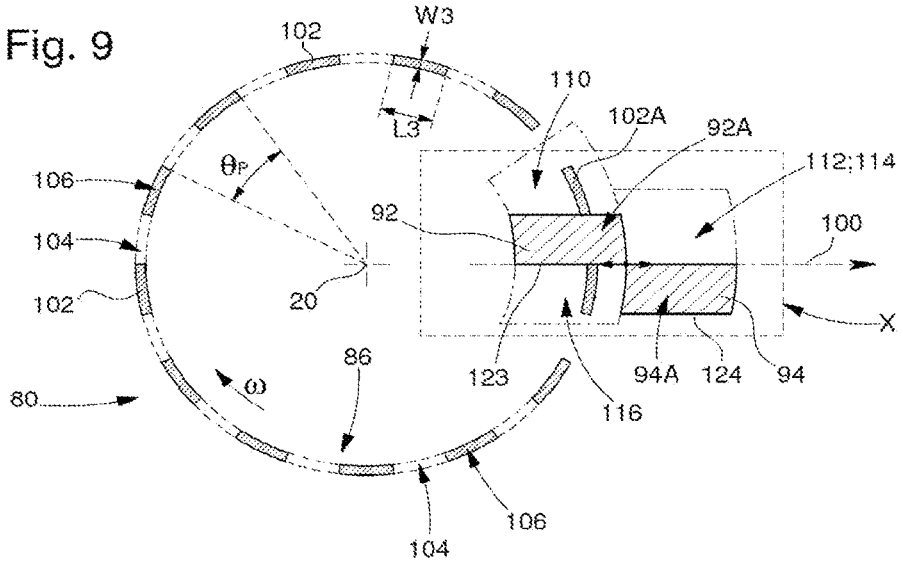
FIG. 9 is a simplified illustration of the oscillator of FIG. 7, to explain the operation of the second main embodiment.
Figure 10A:
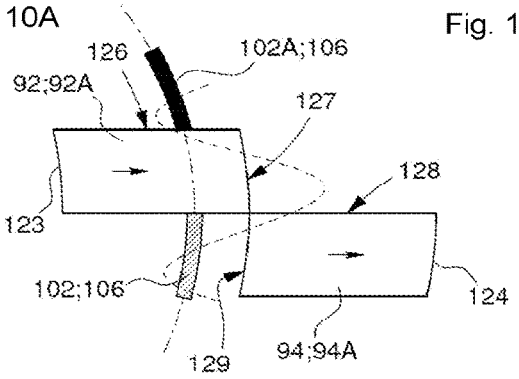
FIG. 10A to 10I show a succession of relative positions between the resonator and an annular magnetic track during a period of oscillation for the oscillator of FIG. 7.
Figure 10B:
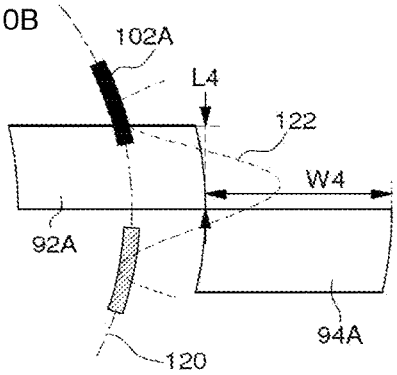
Figure 10C:
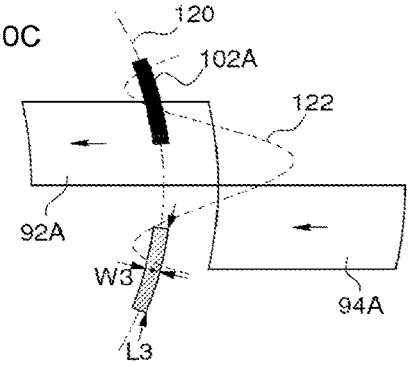
Figure 10D:
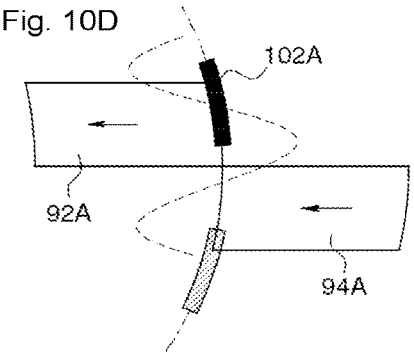
Figure 10E:
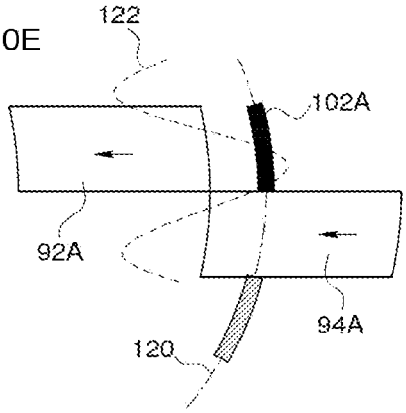
Figure 10F:
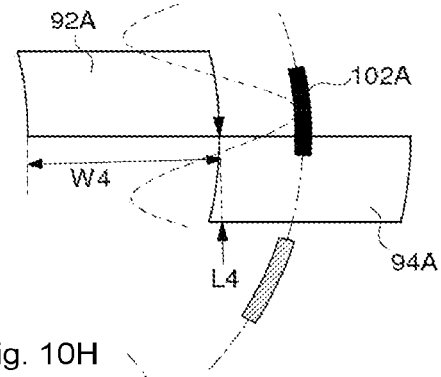
Figure 10G:
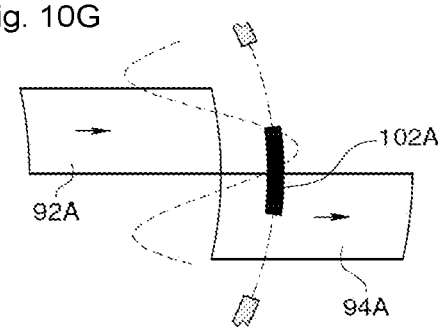
Figure 10H:
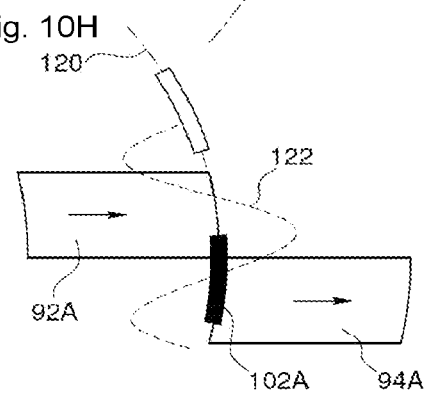
Figure 10I:
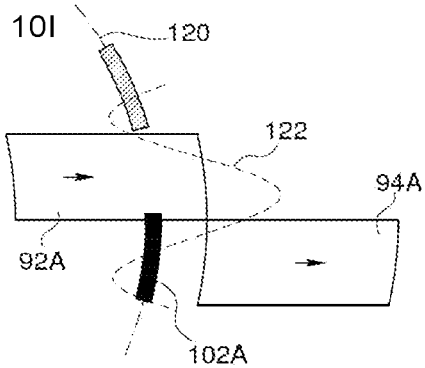

With reference in particular to FIG. 9, a number of characteristics of the invention according to said second main embodiment will be described more precisely below. Each active end portion 92, 94 (of each magnetic coupling element) defines magnetically, in projection in the general plane in which said active end portion extends overall and which comprises its axis of oscillation:

- an entry zone 110, 114 respectively for the second zones 106 (magnets 102, 102A) successively in orthogonal projection to the general geometric plane,
- a zone 92A, 94A respectively of potential magnetic energy accumulation in the oscillator, which zone is angularly adjacent to the above-mentioned entry zone and into which each second zone 106 penetrates in orthogonal projection at least in part from said entry zone, and
- an exit zone 112, 116 respectively adjacent to the potential magnetic energy accumulation zone, said exit zone receiving in orthogonal projection at least the greater part of each second zone 106 exiting from the accumulation zone or from a second subsequent zone.

In general, each second zone produces a stronger repulsion force per unit of angular length, relative to a first adjacent zone, for the potential magnetic energy accumulation zone (the magnetic coupling in repulsion described here) or a stronger attraction force for the entry zone and the exit zone (magnetic coupling in attraction described below). Next, the potential magnetic energy accumulation zone 92A, 94A produces, relative to the entry zone 110, 114 and the exit zone 112, 116, a stronger repulsion force (magnetic coupling in repulsion) or a weaker attraction force (magnetic coupling in attraction) for any same zone of each second zone 106, when said any same zone is superimposed on said potential magnetic energy accumulation zone, at the entry zone or at the exit zone respectively.

In the case of coupling in repulsion, the potential magnetic energy accumulation zone 92A, 94A associated with an active end portion corresponds to magnetic segment 92, 94 formed materially by said active end portion, in other words to an orthogonal projection of said active end portion in its general geometric plane. The entry and exit zones do not have to be formed materially by a portion of the coupling element. In a general variant, said zones correspond to free peripheral regions of the active end portion, in other words filled with air. It will further be observed that the two end portions in the variant described here are arranged on both sides of an arc of a circle, centred on the axis of rotation when the coupling elements are at rest, and have a width (angular direction) corresponding to about half an angular period $\theta_P/2$. The two magnetic segments 92 and 94 are angularly offset by half an angular period. In this configuration which allows a magnetic coupling between the magnetic track and the resonator in each alternation of the oscillation of its oscillating structure, the exit zone 112 associated with the first coupling element corresponds to the entry zone 114 associated with the second coupling element.

The resonator is arranged relative to the magnetic structure 82 such that the first and second potential magnetic energy accumulation zones 92A and 94A are traversed in orthogonal projection by a median geometric circle 120, passing through the middle of the annular magnetic track, during the first and second alternations respectively in each period of oscillation of the two coupling elements in question. Next, each potential magnetic energy accumulation zone has a general contour 123, 124 with: i) a first portion, defining a line of penetration 126, 128 beneath said accumulation zone for each of said second zones 106 successively during the oscillation of the coupling elements, and ii) a second portion defining an exit line 127, 129 from beneath said accumulation zone for said second zone (magnetic repulsion described here) or a second following zone (magnetic attraction) during said oscillation. The exit line is oriented, when the magnetic coupling element in question is in the rest position, substantially in an angular direction parallel to the orthogonal projection of the median geometric circle 120. In the example shown, the exit line is circular and remains parallel to the orthogonal projection of the median geometric circle during the rectilinear oscillation. Said exit line is merged with the orthogonal projection of the median geometric circle when the coupling element is in the rest position (as shown in drawings d) and h) of FIG. 10). Furthermore, each of the second zones has in orthogonal projection a first dimension W3 along a first axis which is perpendicular to the orthogonal projection of the median geometric circle and passes through the centre of said second zone. In the case of a general plane, such an axis is a straight line having a radial direction relative to the axis of rotation 20. Each second zone also has a second dimension L3, along a second axis defined by the orthogonal projection of the median geometric circle 120 in said general plane, which is greater than the first dimension W3.

In the general case, the second dimension is preferably measured along a second axis perpendicular to the first axis and passing through the point of intersection of the orthogonal projection of the median geometric circle with the axis of oscillation of the coupling element in question 96, 98 or through the central axis 100 in the case of two adjacent coupling elements as described here. In this general case, the dimensions of the second zones are measured when the centre of the second zone in question is superimposed on an axis of oscillation or on the central axis 100. Finally, when the magnetic coupling elements are in their rest position, the exit line 127, 129 has a length L4, along the exit zone 112, 116 and along the above-mentioned second axis, which is greater than the first dimension W3 of the second zones.

According to a preferred variant, the axis of oscillation of each active end portion is substantially orthogonal to the median geometric circle 120, in orthogonal projection, at their point of intersection. This is the case in the variant in FIG. 7, although it is the central axis 100 that is radial and therefore exactly orthogonal to the circle 120 centred on the axis of rotation. According to another advantageous variant, as is the case in the variant in FIG. 7, the exit line of the potential magnetic energy accumulation zone along the exit zone and each second zone extend angularly over substantially half an angular period.

Figure 8:
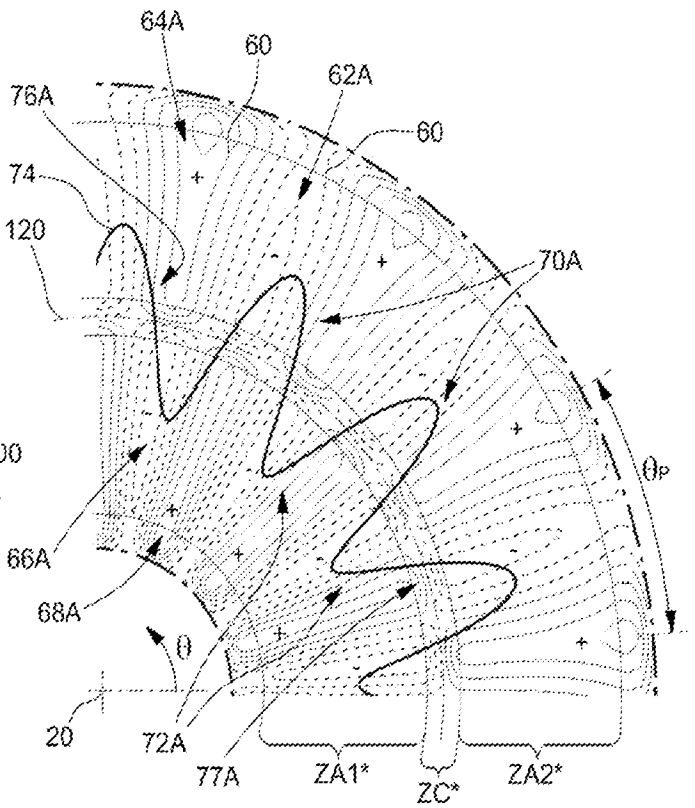

FIG. 8 shows the equipotential curves 60 of the potential magnetic energy in the regulating device 80 of FIG. 7 depending on the position of the central point between the two magnetic segments 92 and 94 in a system of reference linked to the magnetic structure 82. It can be seen that there are zones of minimal energy 62A and 66A and zones of maximal energy 64A and 68A which are radial and elongate. In the useful torque range, the annular magnetic track and each active end portion 92, 94 thus define in each angular period, depending on the relative position of said annular magnetic track and of said active end portion, an accumulation sector 70A, 72A in which the oscillator basically accumulates potential magnetic energy, and a pulse sector 76A, 77A, adjacent to said accumulation zone, in which the coupling element basically receives a pulse. The accumulation sectors are radially extended and define, for the two active end portions, two annular accumulation zones ZA1* and ZA2* respectively. It will be noted that the radial width of said annular accumulation zones depends basically on the extent of the active end portions along their axis of oscillation, and no longer on the radial width of the annular magnetic tracks, as in the first main embodiment. In said annular accumulation zones, the equipotential lines are substantially radial, which indicates that the resulting force is angular (more precisely, tangential) and that the component of said force along the axis of oscillation of each active end portion is very small. In this case, it can be described as pure potential energy accumulation. The pulse sectors are situated in a central pulse zone ZC* corresponding substantially to the annular magnetic track, in other words having the same spatial coordinates as said magnetic track in its general geometric plane.

Thus, the greater the ratio along the central axis 100 between the dimension of the magnetic segments of the resonator, defined by the active end portions of the coupling elements of said resonator, and the dimension of the magnetic track, the greater can be the portion of the free oscillation course taken by said active end portions and the pulses that maintain the oscillation of the resonator located around the rest position of its coupling elements. As an absolute value, the smaller the first dimension W3 of the magnets 102 and therefore the transverse dimension of the magnetic track, the more the pulses supplied to the coupling elements are located around their rest position. Next, the greater the second dimension L3 of the magnets 102, the greater the angular distance of the accumulation sectors. This results from the fact that the superimposition zone between a magnet 102 and the active end portion increases gradually over a relatively large angular distance, as is clear from the succession of relative positions between the magnetic track and the two active end portions, for a period of oscillation, given in FIG. 10. Such a situation is very favourable to good isochronism of the regulating device.

According to a preferred variant, the line of penetration 126, 128 in the potential magnetic energy accumulation zone 92A, 94A is oriented in a direction that is substantially parallel to said axis of oscillation, as is the case in all the embodiments corresponding to the second main embodiment shown in the figures. This characteristic is advantageous for obtaining substantially radial equipotential lines 60 in the potential magnetic energy accumulation sectors. In a close variant, the above-mentioned line of penetration defines a path depending on the degree of freedom. These two variants are merged when the degree of freedom is linear. It will be noted that the accumulation zone considered here is the zone that is determinant in the useful torque range, in other words a zone corresponding substantially to the overall superimposition zone between each magnet of the magnetic track and the active end portion in question during oscillation thereof.

According to a variant, the second dimension L3 of each second zone 106 is at least twice as great as its first dimension W3, and the length L4 of the exit line is at least twice as great as said first dimension W3. In a preferred variant, said second dimension of each second zone is at least four times greater than its first dimension, and the length of the exit line is therefore at least four times greater than said first dimension. According to another variant, the dimension W4 of the line of penetration of the potential magnetic energy accumulation zone 92A, 94A, along the axis of oscillation of the corresponding end portion, is at least five times greater than the transverse dimension W3 of the annular magnetic track along said axis of oscillation in orthogonal projection. In a preferred variant, said dimension W4 of the line of penetration is at least eight times greater than the transverse direction W3.

Figure 11:
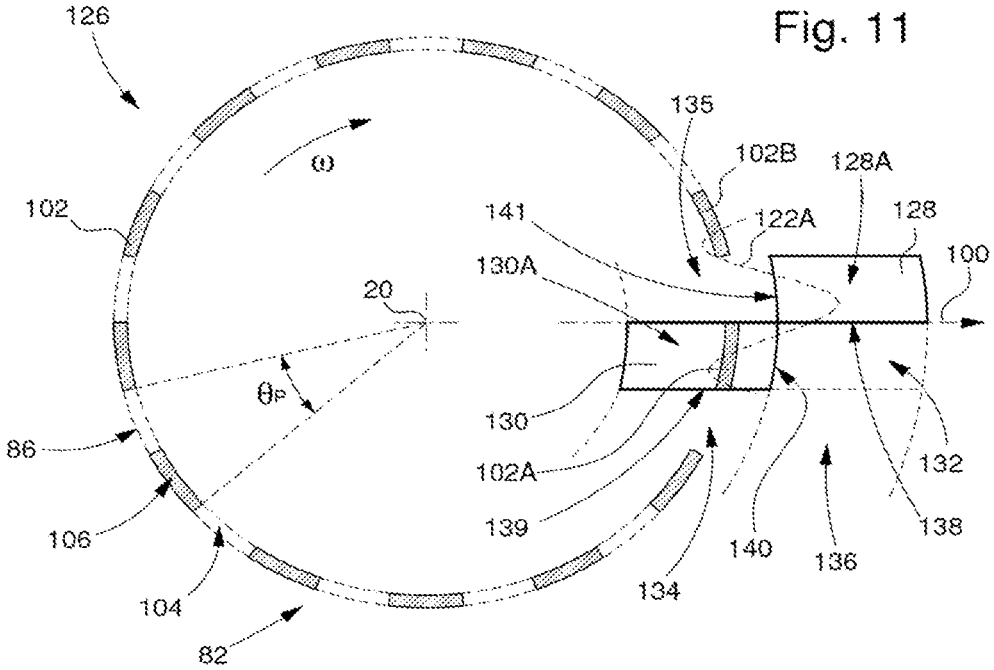
FIGS. 11 and 11A show a first variant of the second main embodiment with magnetic coupling in attraction.
Figure 11A:
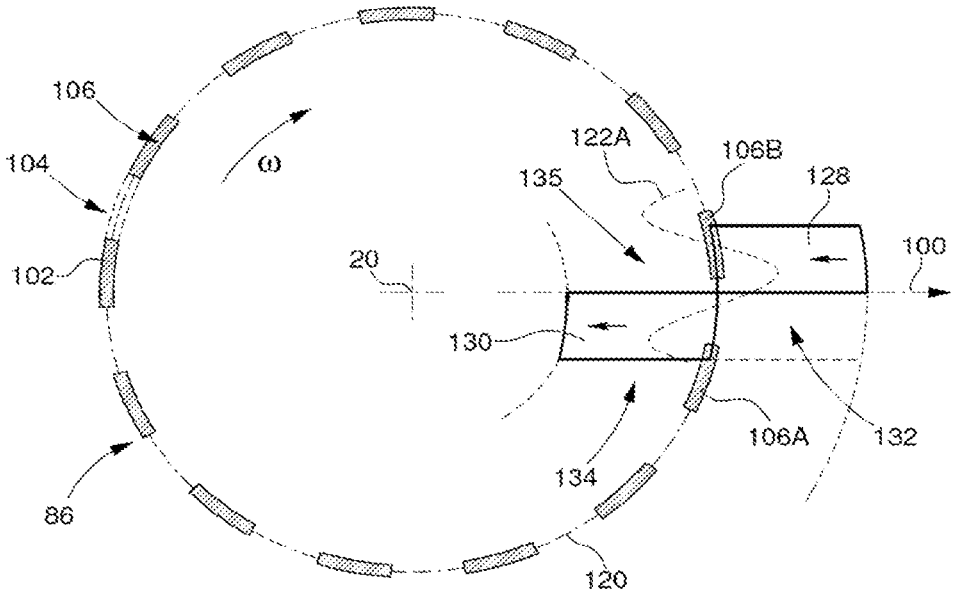

FIGS. 11 and 11A show diagrammatically a variant of the embodiment in FIGS. 7 to 10. This regulating device 126 is distinguished basically by the fact that the magnetic coupling is provided in attraction. The magnetic structure 82 is identical to that of FIG. 7, only the magnetic track 86 being shown with two magnets 102A and 102B chosen from the magnets 102 in order to explain the magnetic interaction of this variant in attraction. The resonator is shown only by the active end portion of a magnetic coupling element which in this case comprises two distinct magnetic portions 128 and 130 made of a ferromagnetic material, said resonator not being provided with a magnetic flux generator so that the two portions are subject to an attraction force on the part of the magnets of the magnetic track. It will be noted that the two portions 128 and 130 have, in the general geometric plane in which they extend, the same shape and the same degree of linear freedom as the two active end portions of the variant in repulsion described earlier, but they are not independent, and both are necessary for the operation of the oscillator. On the other hand, in the variant in repulsion each portion 92 and 94 (FIG. 7) is independent and the oscillator in magnetic repulsion can operate with only one of the two portions 92 and 94. In the present variant, the central axis 100 between the two portions 128 and 130 corresponds to the axis of oscillation of the active end portion. It has a radial direction and is perpendicular to the median geometric circle of the track 86.

The surprising difference between the oscillators 80 and 126 (two distinct coupling elements in the first case and a single coupling element in the second case) results from the fact that the two portions 128 and 130 produce a situation for the magnets 102, when said magnets are superimposed on said two portions, where the potential magnetic energy is lower relative to the surrounding regions filled with air. Thus, the potential magnetic energy accumulation takes place in a surrounding non-magnetic region downstream of the portions 128 and 130. The outline 122A of the oscillation of the end portion relative to the magnetic track is angularly offset by half an angular period $\theta_P/2$ (phase difference of 180°), as are the equipotential curves of the potential magnetic energy in an illustration similar to that of FIG. 8. In the useful torque range, the magnetic portions 128 and 130 define magnetically in orthogonal projection in their general geometric plane:

- a first entry zone 128A and a second said entry zone 130A for the second zones 106 successively of the magnetic track in orthogonal projection to the general geometric plane,
- a first zone 132 and a second zone 134 of potential magnetic energy accumulation in the oscillator in which each second zone 106 of the magnetic track penetrates at least in part in orthogonal projection in a first alternation and a second alternation respectively of a period of oscillation from the first and second entry zones respectively, and
- a first exit zone 130A which receives in orthogonal projection at least the greater part of each second zone 106A exiting from the first accumulation zone 132, and a second exit zone 128A which receives in orthogonal projection at least the greater part of a second following zone 1066 of the magnetic track, said second following zone 1066 exiting from a complementary zone 135 to the second accumulation zone 134 whereas the second zone 106A which precedes it enters entirely into a zone 136 which is equivalent to the second accumulation zone and to the complementary zone 135.

The terminology used here is chosen by analogy with the variant in magnetic repulsion in FIG. 7. However, the two accumulation zones 132 and 134 as well as the complementary zone 135 and the equivalent zone 136 are all formed by the region that is empty or filled with air surrounding the active end portion and that are all magnetically equivalent. The magnetic portions 128 and 130 form the magnetic segments 128A and 130A in their general plane which each constitute an entry zone and also an exit zone. These two segments are arranged so that they are magnetically active in each of the two alternations of each period of oscillation, the first time as an entry zone and the second time as an exit zone, and to produce a pulse around the rest position of the coupling element at the end of each alternation. For terminological consistency, the accumulation zone 134 and the complementary zone 135 are considered together as a potential magnetic energy accumulation zone and the second subsequent zone (magnet 1026) of the magnetic track substitutes for the second zone which precedes it (preceding magnet 102A) to produce a pulse (situation shown in FIG. 11A) following the energy accumulation resulting from the passage of the magnetic segment 130A in an exit zone 134 situated in non-magnetic surrounding region, which defines for said second zone a region of greater potential magnetic energy relative to the magnetic segment 130A for a portion of said second zone superimposed on said magnetic segment, or at the exit zone 134 respectively. The situation shown in FIG. 11 corresponds to a relative position of the coupling element and of the magnetic track for which the potential magnetic energy is minimal.

The resonator of the regulating device 126 is arranged relative to the magnetic structure 82 such that each potential magnetic energy accumulation zone 132, 134 is traversed in orthogonal projection by the median geometric circle passing through the middle of the annular magnetic track during a first alternation, or a second alternation respectively in each period of oscillation of the resonator. In this case, the zones 132 and 134 are spatially delimited by a geometric circle passing through the central point between the two magnetic segments 128A and 130A along the axis of oscillation 100 and centred on the axis of rotation 20 when the coupling element is in the rest position. Each accumulation zone 132, 134 has in part a general contour, determined by the active end portion, which defines first and second lines of penetration 138 and 139 and first and second exit lines 140 and 141, by analogy with the terminology used previously.

Figure 12:
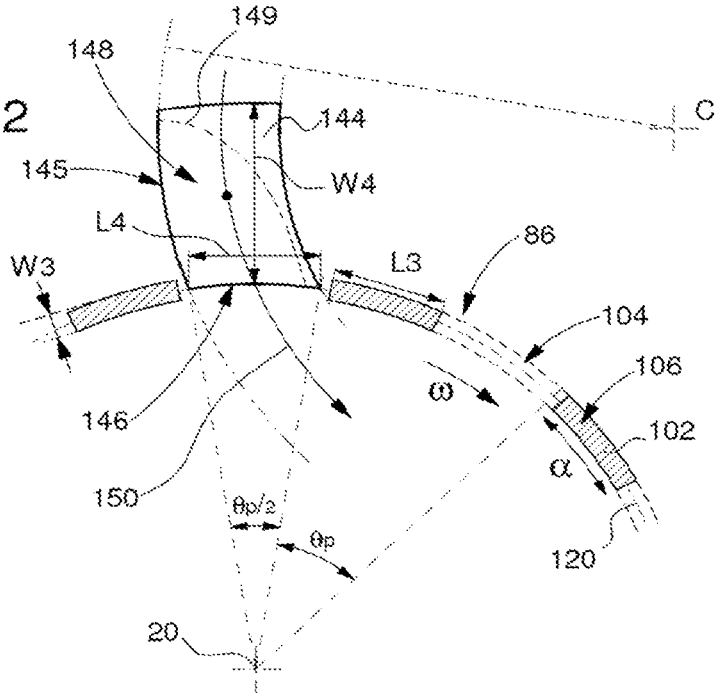
FIG. 12 shows in part a second variant of the second main embodiment, and FIG. 12A gives a simplified alternative.

FIG. 12 shows in part a second variant of the second main embodiment. Said variant is distinguished basically by the fact that the degree of freedom is circular, the element of coupling to the magnetic track 86 oscillating about its own axis of rotation C. The active end portion 144 is in magnetic repulsion with the magnets 102, as in the variant in FIG. 7. The teachings given for said last variant also apply to said second variant. The portion 144 follows a circular axis of oscillation 150 passing through its centre of mass. It is shown in the rest position of the corresponding coupling element of the resonator. In said variant, in order to give a general description of the invention, the axis of oscillation is not arranged perpendicular to an orthogonal projection of the median geometric circle 120. For this particular configuration, the line of penetration 145 and the exit line 146 are optimal. The exit line is merged with the orthogonal projection of the median geometric circle 120 so as to minimise the pulse zones around the rest position. The line of penetration in the potential magnetic energy accumulation zone 148 defines a path depending on the degree of freedom.

It will be observed that the zone 148 is shown here with a smaller surface than the projection of the portion 144. Said zone 148 delimited by a curve 149 shown by the dashed line corresponds effectively to the active accumulation zone. Thus, in a variant, the portion 144 may have an outer contour which follows the curve 149, or which is parallel thereto, passing through the end point of the exit line shown. For a given position of the magnetic track, corresponding to a partial superimposition between a magnet 102 and the portion 144, the zone 148 (or respectively the portion 144) can be displaced along the axis of oscillation outside the pulse zone without being subject in the alternation in question to any potential energy variation. Thus, whatever the oscillation amplitude, the magnetic interaction remains identical with a zone of pure potential energy accumulation in said alternation which terminates in a pulse located at the rest position of the portion 144. The dimensions of said portion 144 and of the magnets 102 have been defined earlier and will not be described again here. They are indicated in the drawings. The exit line 146 extends angularly over half an angular period whereas the magnets 102 extend over a slightly smaller angular distance.

Figure 12A:
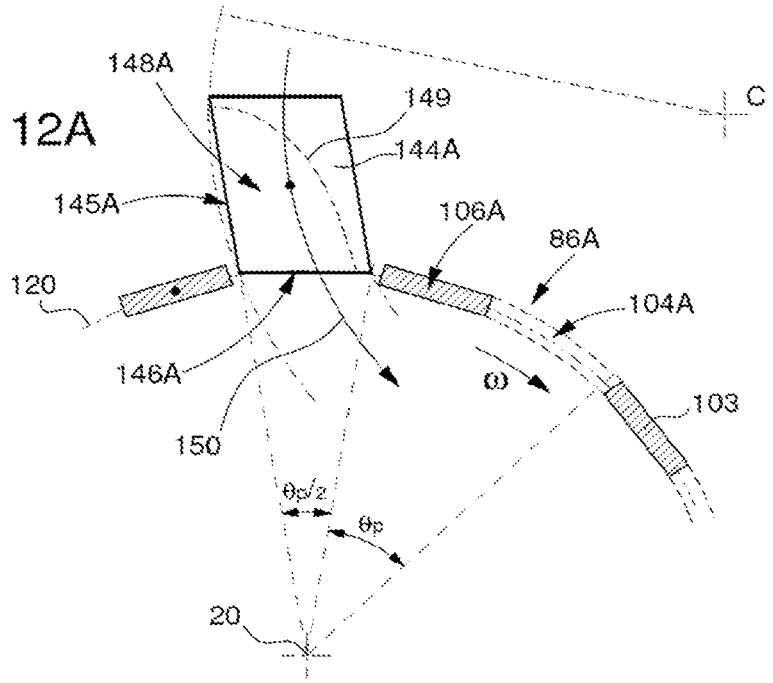

FIG. 12A shows a simplified alternative of FIG. 12 in which the magnets 103 of the magnetic track 86A define second zones 106A of rectangular shape, oriented tangentially to the median geometric circle 120, and first non-magnetic zones 104A between said second zones. The active end portion 144A has a parallelepiped-shaped contour, with a line of penetration 145A and an exit line 146A formed by linear segments. Said linear segments are optimally oriented for this particular configuration. The segments 145A and 146A are formed respectively by the chords of the circular segments 145 and 146 of FIG. 12. In other words, each of said linear segments is parallel to the tangent at the mid-point of the corresponding circular segment. The axis of oscillation 150 passes through the centre of the portion 144A.

Figure 13:
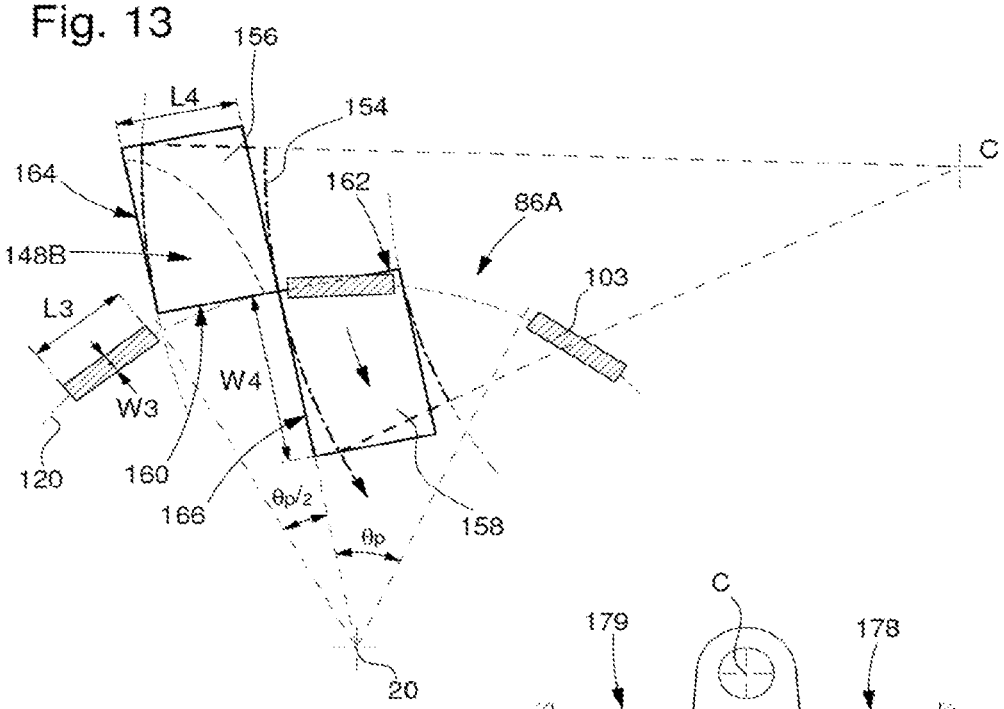
FIG. 13 shows in part a third variant of the second main embodiment.

FIG. 13 shows in part a third variant of the second main embodiment which can be provided in magnetic repulsion or in magnetic attraction according to the teaching given previously. For the following description of said third variant, the repulsion case will be considered. The magnetic structure comprises a magnetic track 86A already described. It will also be noted that said variant is shown with two coupling components oscillating about their own axis C. However, the specific form and positioning of said two coupling components in their rest position also apply to a variant where the degree of freedom is linear, as in FIG. 7. In said third variant, the central axis 154 passing through the central point between the two active end portions 156 and 158 is orthogonal to the median circle 120 at their point of intersection. Taking the central axis 154 as the average axis of oscillation common to the two end portions, a first rectilinear axis is defined, perpendicular to the median circle 120 and passing through said point of intersection and a second rectilinear axis, perpendicular to the first axis and also passing through said point. In this system of orthogonal axes, the portions 156 and 158 define, in their general plane, rectangular magnetic segments each with an exit line 160, 162 on the second axis. The lines of penetration 164 and 166 of said two magnetic segments are parallel to the first axis. The potential magnetic energy accumulation zone 148B shows that a portion of the magnetic segments is not active. However, the rectangular shape simplifies the construction of the resonator.

It will be noted that, in the context of the invention, the exit lines 160 and 162 are considered as being oriented, when the magnetic coupling element is in the rest position as shown in FIG. 13, substantially in an angular direction parallel to the orthogonal projection of the median geometric circle 120 in the general geometric surface of the end portions 156 and 158. They are in fact tangent to the orthogonal projection of the circle 120 at the point of intersection of the central axis 154 with said orthogonal projection, said point of intersection corresponding to an inner corner of each magnetic segment. In a variant shown in FIG. 13 in dashed lines, the rectangular shapes are replaced by annular sectors of centre C on the axis of rotation of the resonator. The respective exit lines of the magnetic segments of said variant are identical to those of the rectangular segments. However the lines of penetration are circular depending on the degree of freedom of the corresponding coupling elements. They each define a path depending on the degree of freedom and are therefore oriented in a direction that is substantially parallel to the respective axes of oscillation. Next, each of the second zones 103 has in orthogonal projection, when the centre of said second zone is superimposed on the central axis, a first dimension W3, along the above-mentioned first axis, and a second dimension L3, along the above-mentioned second axis, which is greater than the first dimension. Finally, when the magnetic coupling elements are in the rest position, the respective exit line 160, 162 has a length, along the exit zone and along said second axis, which is greater than the first dimension W3 of the second zones.

A plurality of regulating devices according to the invention will be described below. The operating principle as well as the spatial and dimensional relationships specific to the invention and already described above also apply to said regulating devices and will not be described again in the description of said regulating devices.

Figure 14:
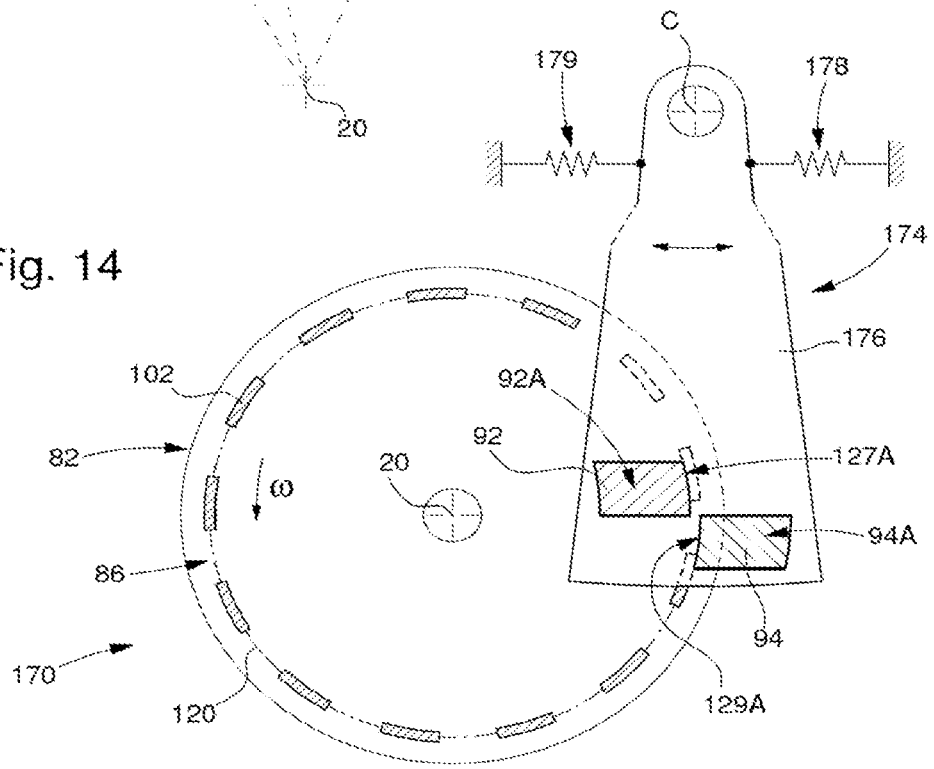
FIG. 14 shows diagrammatically an alternative to FIG. 13 with a resonator of the balance wheel-spiral spring type.

The regulating device 170 of FIG. 14 comprises a magnetic escapement mobile 82 supporting a magnetic track 86, which has already been described, and a resonator 174 formed by a balance wheel 176 (shown diagrammatically) oscillating about the axis C parallel to the axis of rotation 20. The balance wheel is associated with resilient means 178, 179 which apply a return force when said balance wheel moves away from its rest position (zero position shown in FIG. 14). The balance wheel comprises two active end portions 92 and 94 corresponding basically to those already described in FIGS. 7 and 9, except that the exit lines 127A and 129A of the magnetic segments 92A and 94A are not superimposed on the median circle 120, but are situated a short distance from said circle on both sides, such that said circle is situated in the middle of an annular intermediate zone between the two magnetic segments. Said intermediate zone is magnetically homogeneous, in this case, non-magnetic.

Figure 15:
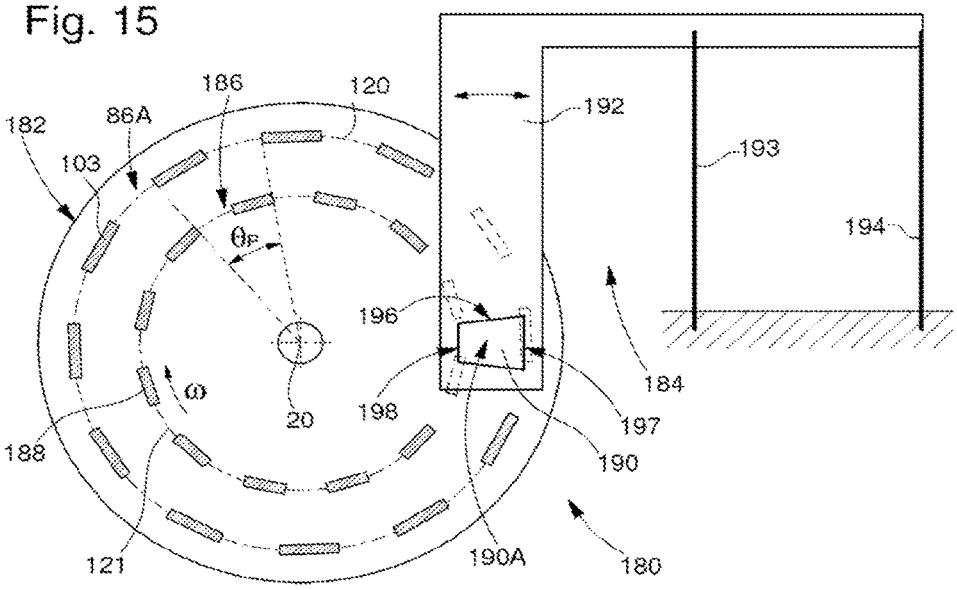
FIG. 15 shows diagrammatically a third embodiment of the invention.

According to a third embodiment, the regulating device 180 of FIG. 15 comprises a magnetic escapement mobile 182, with two concentric magnetic tracks 86A and 186, and a resonator 184. The first track 86A has already been described and the second track 186 made up of a plurality of magnets 188 is similar thereto, but with a smaller diameter. The potential magnetic energy of the oscillator 180 varies angularly along said second track with the same angular period $\theta_P$ and in a similar way to the variation of the first track. The first and second magnetic tracks have an angular displacement equal to half the angular period. The resonator 184 comprises a coupling element with an active end portion 190 formed by a magnet arranged in repulsion and defining in its general plane a tapered potential magnetic energy accumulation zone 190A. Said portion 190 is arranged in a non-magnetic support 192 fixed to the horological movement by two spring rods 193 and 194 allowing the support 192 to oscillate. The active end portion is coupled to the two magnetic tracks. The accumulation zone 190A defined by said portion has a common line of penetration 196 for the magnets of both tracks and both exit lines 197 and 198 defining respectively the two parallel and substantially angular portions of said tapered zone. These two lines have different lengths as they extend substantially over the same angular distance which is slight less than half an angular period along median geometric circles 120 and 121 of different diameters. In a first alternation of each period of oscillation, the portion 190 is coupled to the first track 86A. In a similar way, it is coupled to the second track 186 in the second alternation of each period of oscillation. The oscillating structure 192 receives a pulse at the end of each alternation around its rest position (position shown).

Figure 16:
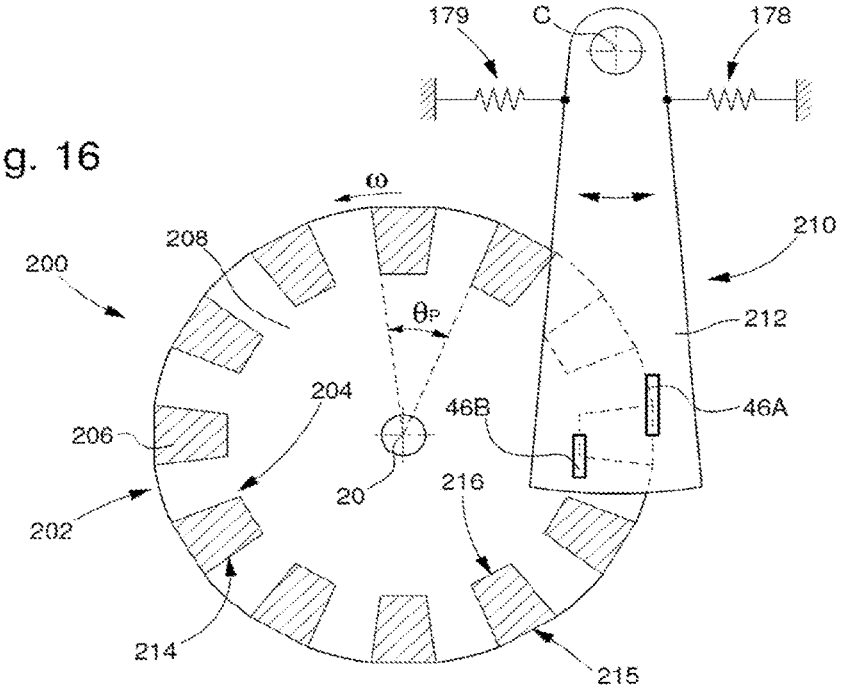
FIG. 16 shows diagrammatically a fourth embodiment of the invention.

According to a fourth embodiment, the regulating device 200 of FIG. 16 comprises a magnetic escapement mobile 202 with a radially extended magnetic track 204, as described in the first main embodiment. The magnets 206 of said track are tapered with the two sides parallel in a tangential direction relative to the axis of rotation 20. The oscillator 200 also comprises a resonator 210 of the same type as the one in FIG. 14, said resonator also comprising two coupling elements carried by a balance wheel 212 made of a non-magnetic material, but is distinguished therefrom by the fact that the corresponding two active end portions 46A and 46B are radially narrow relative to the magnets 206 in the rest position of the coupling elements (position shown). The two portions 46A and 46B are situated on both sides of a straight line perpendicular to their longitudinal direction and substantially radial relative to the axis of rotation 20 of the escapement mobile. They both extend relative to said axis over an angular distance substantially equal to half an angular period of the magnetic tracks, with an angular displacement of a half period. The longitudinal axis of each portion 46A and 46B is substantially perpendicular to the axis of oscillation of the balance wheel 212. The line of penetration 214 defined by each magnet of the magnetic track is common to the two active end portions. In an angular position of a magnet 206 where its central axis is perpendicular to the two longitudinal axes of the two portions 46A and 46B in the rest position of the corresponding coupling elements, the longitudinal axis of the portion 46A is substantially superimposed on the exit line 215 defined by the outer edge of said magnet whereas the longitudinal axis of the portion 46B is substantially superimposed on the exit line 216 defined by the inner edge of said magnet. The balance wheel 212 thus receives two pulses per period of oscillation located substantially around its rest position.

Figure 17:
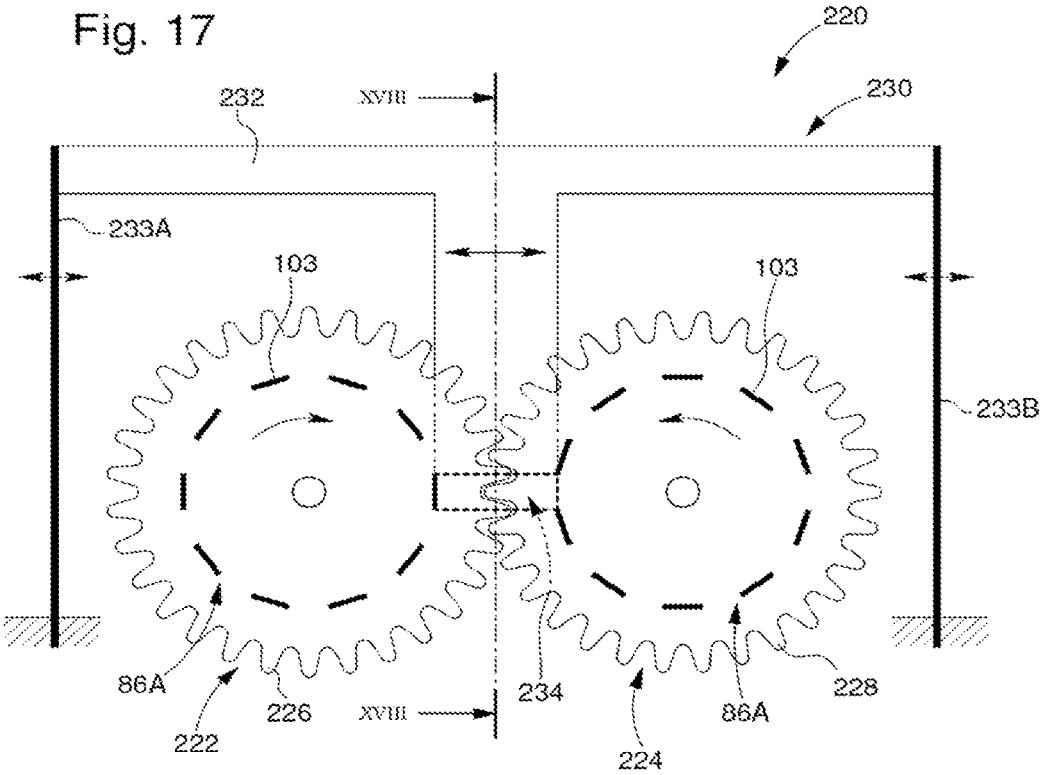
FIG. 17 shows diagrammatically a fifth embodiment of the invention.
Figure 18:
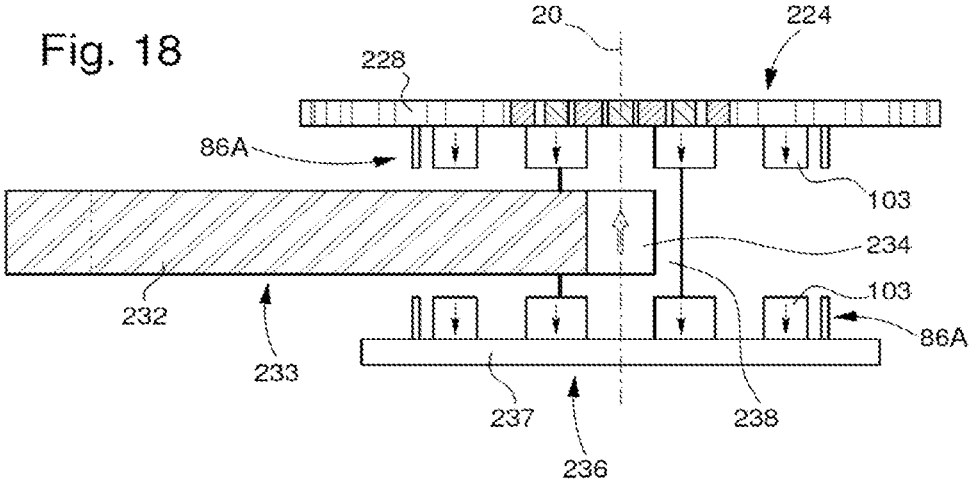
FIG. 18 is a view in cross section of FIG. 17.

With reference to FIGS. 17 and 18, a fifth embodiment of the invention will be described below. The regulating device 220 comprises a first magnetic escapement wheel 222 and a second magnetic escapement wheel 224 which are identical and are arranged in the same general plane. Said two escapement wheels form two magnetic structures each defining a radially narrow magnetic track 86A with a plurality of magnets 103. The potential magnetic energy of the oscillator therefore varies angularly in a similar way along said two tracks 86A. The two escapement wheels mesh directly with one another via their respective teeth 226 and 228. The two magnetic tracks are coupled to the same coupling element 234 of the resonator 230 which also comprise a T-shaped non-magnetic support 232 and two spring rods 233A, 233B at the two ends of the transverse bar of said support. The magnet 234 is arranged at the free end of the central bar of the support. The spring rods are arranged such that the magnet 234 can oscillate along a slightly curved axis of oscillation. It will be observed that in a variant, the resonator may have two distinct coupling elements coupled to the two magnetic tracks respectively supported by the two wheels 222, 224 respectively. The magnet 234 is arranged in magnetic repulsion to the magnets 103. The regulating device 220 also comprises two additional magnetic structures situated respectively facing the two wheels 222, 224 and coaxial thereto. Said two complementary structures are arranged on the other side of the magnet 234 forming a common coupling element for the two magnetic tracks situated on both sides of the magnet in an axial direction. A single additional magnetic structure 236 is shown in FIG. 18, but the second structure is similar.

In the variant shown, the structure 236 comprises a plate 237 supporting a magnetic track 86A identical to that of the escapement wheel 224, and arranged in an angularly identical way. However, it will be noted that the two wheels mesh such that, along a transverse axis passing through their respective two axes of rotation corresponding substantially to the axis of oscillation of the magnet 234, the two magnetic tracks have a magnetic phase difference of 180°, the first track being coupled in a first alternation whereas the second track is coupled in a second alternation of each period of oscillation, the coupling element 234 receiving a pulse at the end of each alternation, which pulse is located around the rest position of the oscillating structure in accordance with the concept of the present invention. In the variant shown, the magnetic tracks 86A of the superimposed magnetic structures are rigidly connected in rotation, the plate 237 being connected to the wheel 224 by a central tube 238. In another variant, said two superimposed tracks arranged on both sides of the general plane of the magnet 234 are not rigidly connected in rotation.

Figure 19:
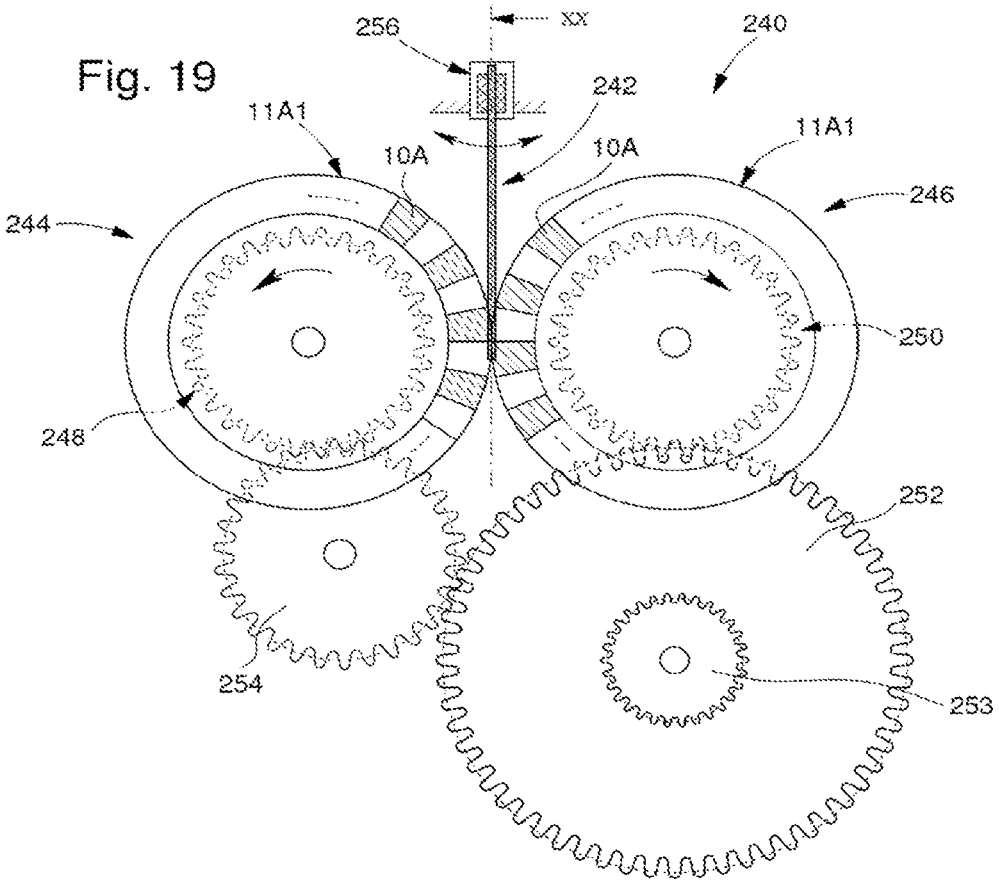
FIG. 19 shows diagrammatically a sixth embodiment of the invention.
Figure 20:
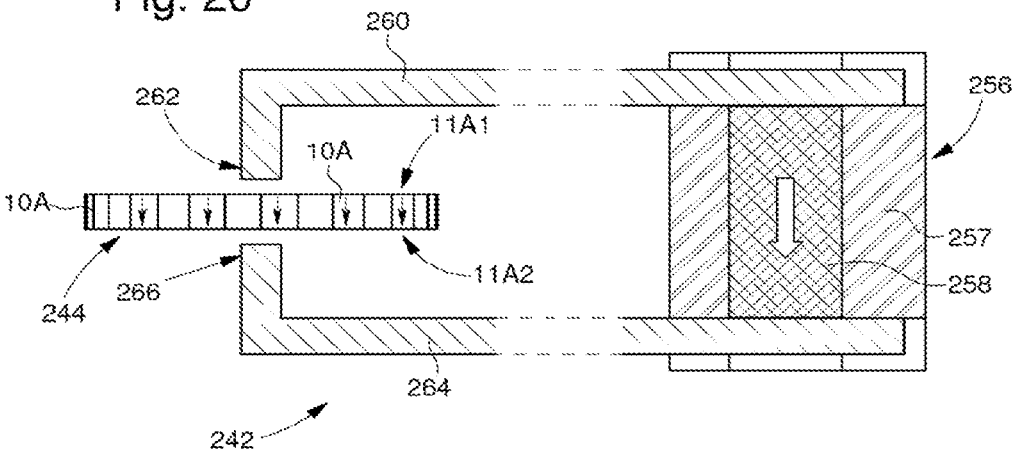
FIG. 20 is a view in cross section of FIG. 19.

With reference to FIGS. 19 and 20, a sixth embodiment of the invention will be described below. The regulating device 240 is based on the same concept as the previous embodiment. In the variant proposed here, the relative dimensioning of each coupling component and of the magnetic tracks corresponds to the first main embodiment, whereas the variant proposed in the previous embodiment corresponds to the second main embodiment. Apart from this basic difference, the variants of each of these two embodiments can be applied to the other embodiment by adapting some of the constructional elements. The oscillator 240 comprises a resonator 242 and two magnetic structures 244 and 246 situated in the same general plane and rigidly connected respectively to two wheels 248 and 250 which mesh with each other indirectly via two intermediate wheels 252 and 254 arranged so that the two magnetic structures turn at the same speed but in opposite directions. The intermediate wheel 252 comprises a pinion 253 for the input of a torque supplied to the regulating device. The resonator is formed by two spring rods 260 and 264 made of a material with high magnetic permeability and comprising two respective end portions 262 and 266 situated on both sides of the general plane of the two magnetic structures respectively. Furthermore, the resonator comprises a magnetic flux generator 256 formed by a magnet 258 housed in a rigid structure 257, which is arranged to allow two spring rods to be fixed on both sides of the magnet 258 so as to produce a closed magnetic path for the magnet flux passing through the spring rods, in particular through the end portions 262 and 266 and the air gap between said two ends. In the region of the magnet 258, the spring rods may widen in order to channel all the magnetic flux of said magnet.

The two magnetic structures are formed by two disks each having at their periphery a magnetised ring defining a plurality of magnetised zones 10A, which are provided over the height of the disk to produce an axial magnetic flux from both sides of the magnetised ring. Thus, said magnetised zones form in the region of the upper surface of the magnetic structure a first magnetic track 11A1 and in the region of the lower surface a second, equivalent magnetic track 11A2. Said two magnetic tracks are coupled respectively with the two active end portions 262 and 266. It will be observed that the magnetised zones may be formed by a plurality of separate magnets or by a ring made of the same material of which only the zones 10A are magnetised. In another advantageous variant, said ring is magnetised with an alternation of the direction of polarity in each angular period. There is therefore an alternation of the north and south magnetised zones in each magnetic track. There is therefore a passage from magnetic coupling in attraction to magnetic coupling in repulsion in each angular period, which advantageously allows the potential energy difference between the minimal and maximal potential energy zones to be increased. Said variant in a magnet-magnet coupling applies equally to all the embodiments.

In other variants of the last two embodiments (not shown), the two magnetic tracks coupled to the resonator are respectively rigidly connected in rotation to two mobiles that do not have a meshing relationship with each other. Said two mobiles may be coaxial or situated next to each other with two separate axes of rotation. According to two particular variants, said two mobiles are coupled to the same coupling element or respectively to two coupling elements of the resonator. The two mobiles in rotation may each be driven by their own mechanical energy source. However, it is also possible for only a first mobile to be driven in rotation by torque whereas the second mobile is in reality driven in rotation by the resonator excited by the first mobile, in other words driven through the resonator which transmits thereto the energy received. Persons skilled in the art will therefore realise that a plurality of embodiments can be envisaged based on the concept of the fifth or sixth embodiments.

Figure 21:
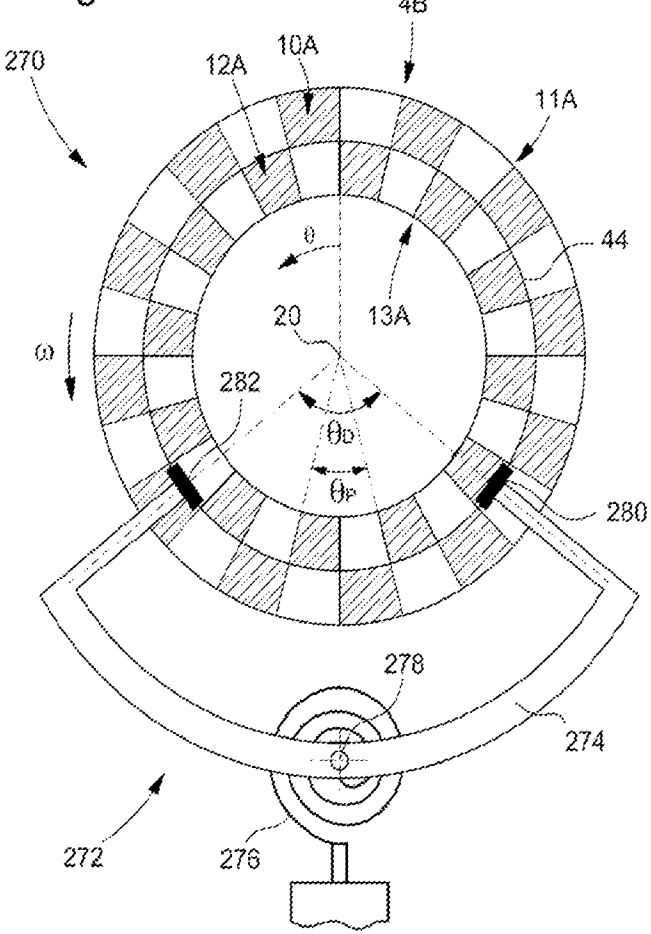
FIG. 21 shows diagrammatically a seventh embodiment of the invention.

FIG. 21 shows a seventh embodiment of a regulating device 270 according to the invention. The magnetic structure 4B is similar to that described in FIG. 5. It comprises two tracks 11A and 13A which are concentric. The resonator 272 is of the balance wheel-spiral spring type with a rigid balance wheel 274 associated with a spiral spring 276. The balance wheel may take various forms, in particular a circular form as in a conventional horological movement. The balance wheel pivots about an axis 278 and comprises two magnetic coupling components 280 and 282 according to the invention which are angularly displaced relative to the axis of rotation 20 of the magnetic structure 4B. Said two components are formed by two magnets. The angular displacement of the two magnets and their positioning relative to the structure 4B are provided such that said two magnets define the same zero position circle 44 and have in their rest position an angular displacement $\theta_D$ equal to an integer of angular period $\theta_P$ increased by a half period. Thus said two magnets have a phase difference of $\pi$. The circle 44 corresponds substantially to the interface circle (common limit) of the two magnetic tracks 11A and 13A. Preferably, the axis of rotation 278 of the balance wheel is positioned at the intersection of the two tangents to the zero position circle 44 at the two points of intersection respectively of said circle with the two respective axes of oscillation of the two magnets of the resonator. It will be noted that it is preferable for the balance wheel to be in equilibrium, more precisely for its centre of mass to be located on the axis of the balance wheel. Persons skilled in the art will find it easy to configure the various forms of balance wheels that have this important characteristic. It will therefore be understood that the different variants shown in the figures are diagrammatic and the problem associated with the inertia of the resonator is not specifically dealt with in said figures. Furthermore, arrangements that guarantee a zero result of the magnetic forces acting radially and axially on the axis of the balance wheel are preferred. It will be noted that, in a variant, provision is made for a balance wheel with spring rods defining a fictitious axis of rotation, in other words with no pivoting, instead and in place of the balance wheel-spiral spring. During the passage in the central pulse zone located around the interface circle 44, each of the magnets 280 and 282 receives a pulse in each alternation of each period of oscillation. In this case there is therefore a double pulse. In a variant with two magnetic structures 4B arranged coaxially on both sides of the magnets 280 and 282, four simultaneous pulses are obtained at the end of the first alternation and of the second alternation in each period of oscillation. Such a system has a strong coupling between the resonator and the magnetic structures driven rotating by a torque within a useful range, and said range can therefore be relatively extensive.

Figure 22:
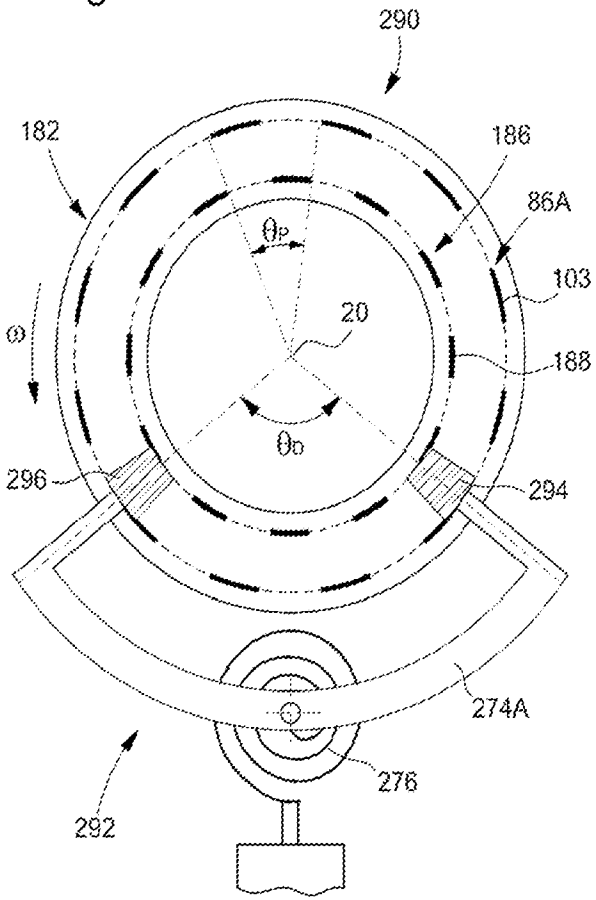
FIG. 22 shows diagrammatically an alternative to FIG. 21 in a configuration corresponding to the second main embodiment.

FIG. 22 is an alternative to the device of FIG. 21, the device of FIG. 22 being based on the second main embodiment whereas the device of FIG. 21 is based on the first main embodiment. Said alternative concerns a regulating device 290 with two concentric magnetic tracks 86A and 186 of small radial dimension forming the magnetic structure 182, which is similar to that already described in FIG. 15 (the only difference is the arc-shaped form of the magnets 103 and 188 in FIG. 22). Said regulating device further comprises a resonator 292 of the balance wheel-spiral spring type described earlier. The resonator therefore has a spiral spring 276 or other appropriate resilient element and a balance wheel 274A that has two arms of which the two respective free ends carry two coupling elements 294 and 296 respectively formed by two magnets arranged in repulsion of the magnets of the magnetic tracks. Each coupling element is formed by a magnetised zone similar to the element 190 of FIG. 15. The operation of the oscillator 290 is therefore similar to that of said FIG. 15 for each of the two magnetised zones 294 and 296. Said two magnetised zones are offset by an angle $\theta_D=\theta_P\cdot(2N+1)/2$, N being an integer. If a first magnetised segment of the resonator 292 is coupled to a first magnetic track, the second magnetised segment is then coupled to the second magnetic track. The magnetic coupling between the resonator and the magnetic structure is therefore doubled relative to the embodiment of FIG. 15. Various remarks and variants mentioned for FIG. 21 also apply in this case.

Figure 23:
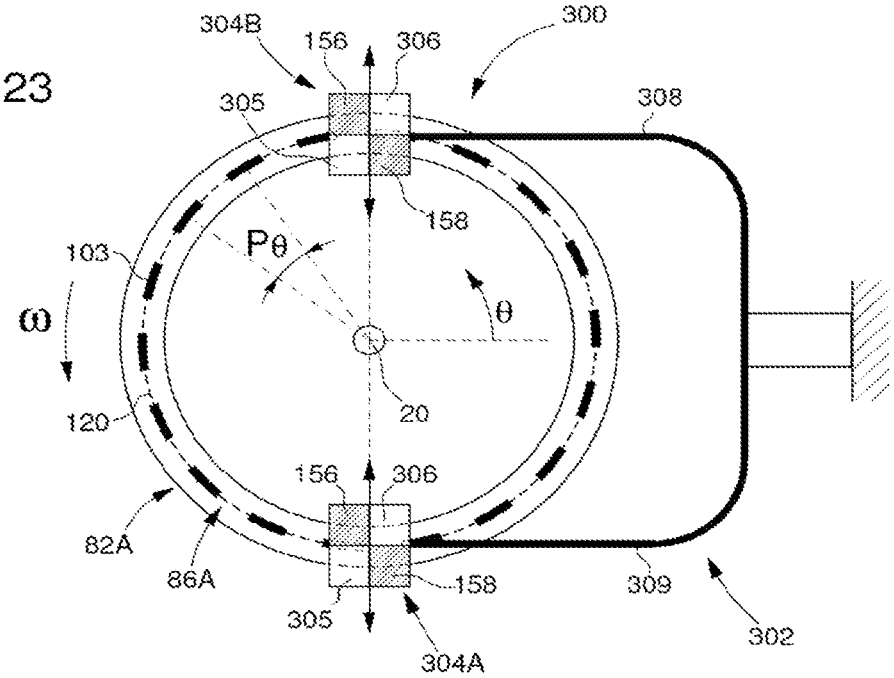
FIG. 23 shows diagrammatically an eight embodiment of the invention.

FIG. 23 shows diagrammatically an eighth embodiment. The regulating device 300 comprises a magnetic structure 82A similar to that described in FIGS. 12A and 13 and a resonator 302 formed by a diapason with two arms 308 and 309 (shown diagrammatically) which have two identical magnetic tips 304A and 304B at their two free ends. Each magnetic tip is formed by two magnetic segments 156 and 158 and by two complementary non-magnetic portions 305 and 306. The magnetic segments 156 and 158 are arranged in an identical manner to the two active end portions which are described in FIG. 13. The magnetic operation in this case is equivalent to that described with reference to FIGS. 9 to 11A and 13, and will therefore not be explained again here. It will be observed that the magnetic coupling may be provided in repulsion (see FIGS. 9 and 10) or in attraction (see FIGS. 11 and 11A). The magnetic track has an even number of magnets and therefore of angular periods so that the two tips 304A, 304B advantageously oscillate in opposite directions. In another variant with a perfectly symmetrical diapason (causing one of the two tips to be subjected to axial symmetry along an axis of symmetry substantially tangent to the median circle 120), an odd number of magnets must be provided along the magnetic track 86A. Thus, the resonator is formed by a diapason of which two free ends of its resonant structure carry the first and second magnetic coupling elements respectively.

Figure 24:
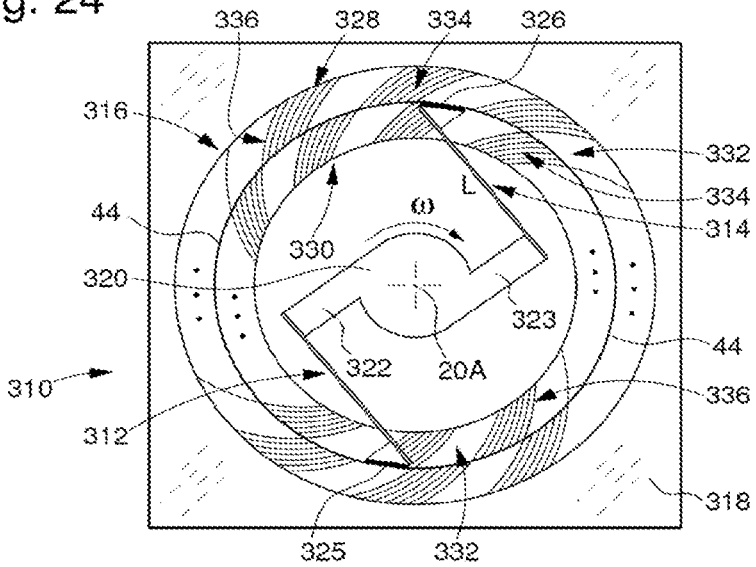
FIG. 24 shows diagrammatically a ninth embodiment of the invention.

FIG. 24 shows a ninth embodiment of the invention. The regulating device 310 is distinguished basically from the previous embodiments by three particular characteristics. Firstly, it comprises two independent resonators 312 and 314, in other words that do not have a common resonant mode. However, said two resonators are identical. Secondly, the magnetic structure 316 is provided fixed on a support or a bottom plate 318 of a horological movement, whereas the two resonators 312 and 314 are driven rotating at the angular frequency ω by a torque supplied to a rotor 320 which comprises two rigid arms 322 and 323 at the respective free ends of which the two resonators are arranged. Said two resonators each comprise a spring rod at the free end of which is arranged an elongate magnet 325, 326. According to the invention, said magnets are arranged tangentially to an interface circle 44 between the two magnetic tracks 328 and 330 when the respective resonators are in the rest position, such that said interface circle corresponds to a zero position circle for the two active end portions defined by the magnets 325 and 326. Each magnetic track comprises first zones 332 and second zones 334 that have properties already described in the disclosure of the first main embodiment. Each of the two magnets an oscillator defines with the two magnetic tracks. It will be observed that the reversal of the drive in the region of the 'resonator—magnetic track' system with a torque applied to the resonator in order to drive said resonator rotating about an axis of rotation 20A merged with the central axis of the magnetic structure in no way changes the magnetic interaction between the resonator and the magnetic structure which was disclosed previously, so that said reversal may be implemented as a variant in the other embodiments.

The third particular characteristic of said embodiment comes from the fact that, in an embodiment corresponding to the first main embodiment, the oscillation of the coupling elements is not radial relative to the axis of rotation 20A of the rotor 320, meaning that the axis of oscillation intercepts the zero position circle 44 in a non-perpendicular manner. The degree of freedom of the coupling element of each resonator is located substantially on a circle of which the radius is substantially equal to the length L of the spring rod and centred at the anchoring point of said rod. In order to obtain, according to a preferred variant of the invention, a potential magnetic energy gradient of substantially zero depending on the degree of freedom of each resonator (the two resonators having an axial symmetry of geometric axis 20A) in the useful potential magnetic energy accumulation zones, provision is made for the lines of penetration 336 of the second zones 334 of each of the two tracks 328 and 330 to follow arcs of a circle along the axis of oscillation of each of the coupling elements when the line of penetration in question and an axis of oscillation are superimposed. Said third particular characteristic corresponds by analogy to the situation described in FIGS. 12 and 12A in the context of the second main embodiment.

A tenth embodiment will be described below with reference to FIG. 25A to 25D, which is based on the embodiment in FIG. 22 as regards the magnetic coupling between the coupling elements of the resonator 346 and an annular magnetic track 344 of an escapement mobile 342. In this embodiment, which can be referred to as a 'magnetic cylinder escapement', the regulating device 340 is distinguished by the fact that the resonator comprises a truncated annular magnet 352 rigidly connected to a balance wheel 348 which is associated with a spiral spring 350. The truncated annular magnet defines the wall of a laterally open section of cylindrical tube. Said truncated annular magnet is situated in a first general plane parallel to a second general plane defined by the annular magnetic track, such that said annular magnet passes above the escapement mobile to be magnetically coupled in repulsion, and therefore without contact, to the annular track 344 driven rotating by a torque. It will be observed that in a variant no balance wheel is provided other than the cylindrical tube section with its pivoting means. The truncated annular magnet is arranged to turn about the axis C. A shaft may be provided in said variant, said shaft being connected to the annular magnet for example by a plate supporting said magnet and mounted fixed on the shaft. The plate is provided on the other side of the escapement mobile relative to said annular magnet.

According to the concept set out with reference to FIGS. 9 and 10 in particular, the annular magnet 352 forms two active end portions of two coupling elements, said two ends being formed in the variant shown by one and the same truncated annular magnet. In a variant limiting the oscillation amplitudes, two arc-shaped magnets of the same radius and connected by non-magnetic fixing portion may be provided. Furthermore, the truncated annular magnet defines in its general plane a first line of penetration 354, corresponding to its outer wall and a first exit line 356 at a first end of said annular magnet in its general plane. The second end defines a second exit line 357 while a second line of penetration 355 is defined by the inner wall of said annular magnet. In this mode of coupling in repulsion, as set out earlier, the annular magnet corresponds in orthogonal projection to a potential magnetic energy accumulation zone. It will be observed that the lines of penetration are oriented according to the degree of freedom of the resonator as they are circular and centred on the axis of oscillation C. They define paths according to said degree of freedom such that, for a given angular position of the magnetic track 344, the potential magnetic energy of a magnet 343 in part superimposed on the annular magnet 352 does not vary when said magnet oscillates in a first alternation of the period of oscillation of the balance wheel-spiral spring (FIGS. 25A and 25C) before reaching the exit line (FIGS. 25B and 25D) where a pulse P is supplied to the balance wheel via the annular magnet.

Figure 25A:
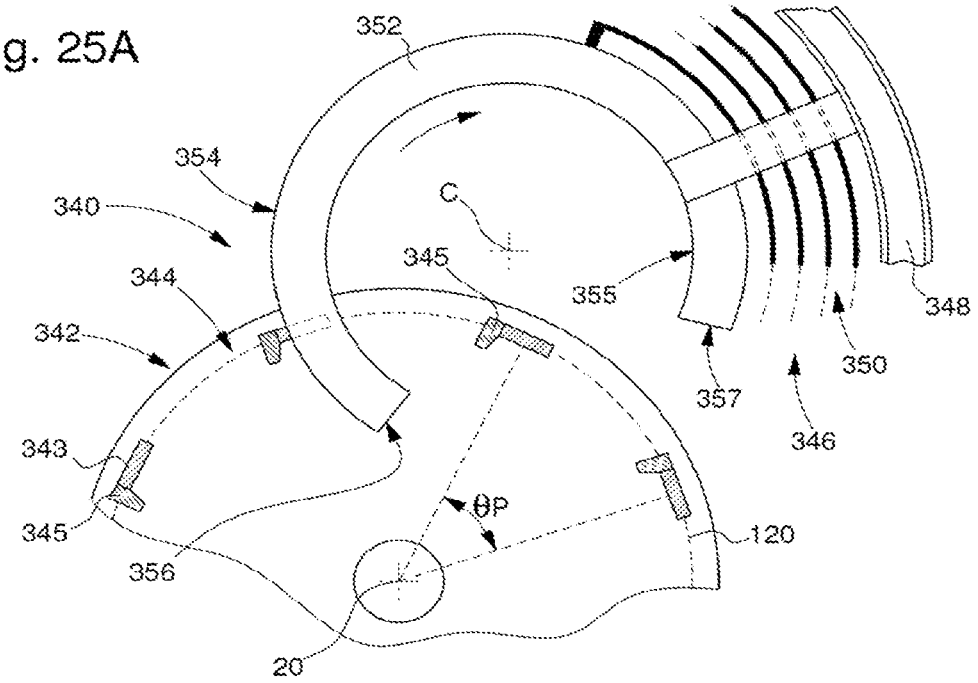
FIG. 25A to 25D show diagrammatically a tenth embodiment of the invention in four different relative positions respectively of the resonator and of the escapement wheel.
Figure 25B:
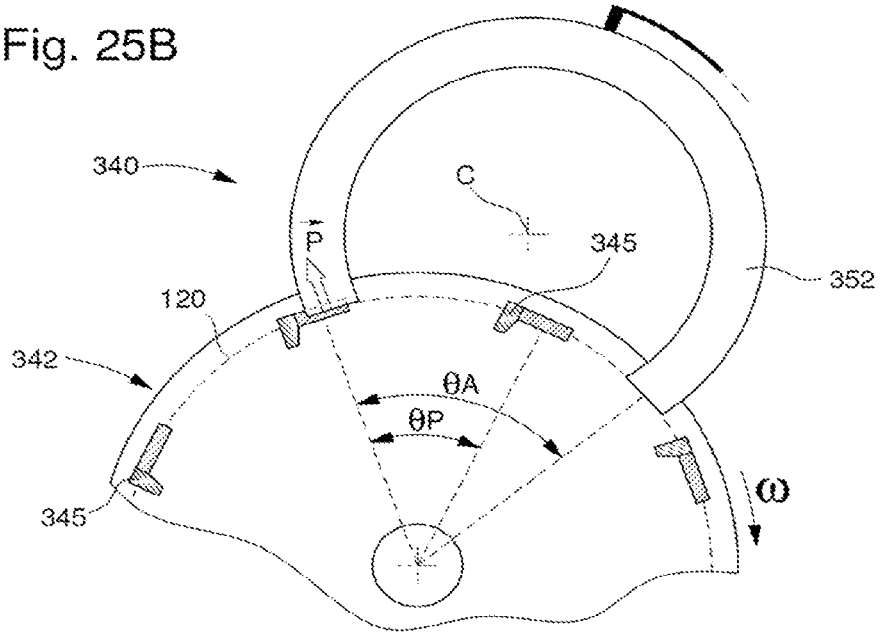
Figure 25C:
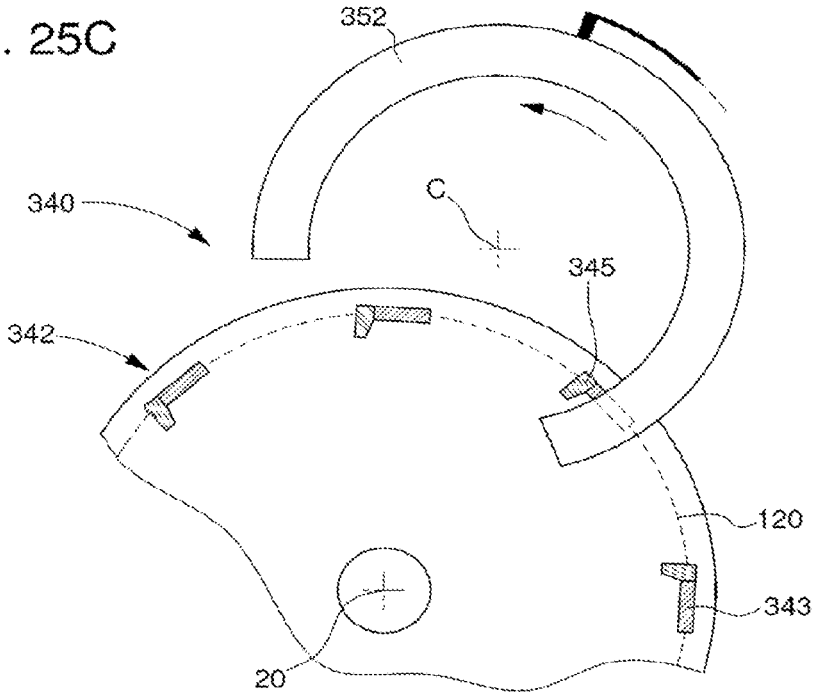
Figure 25D:
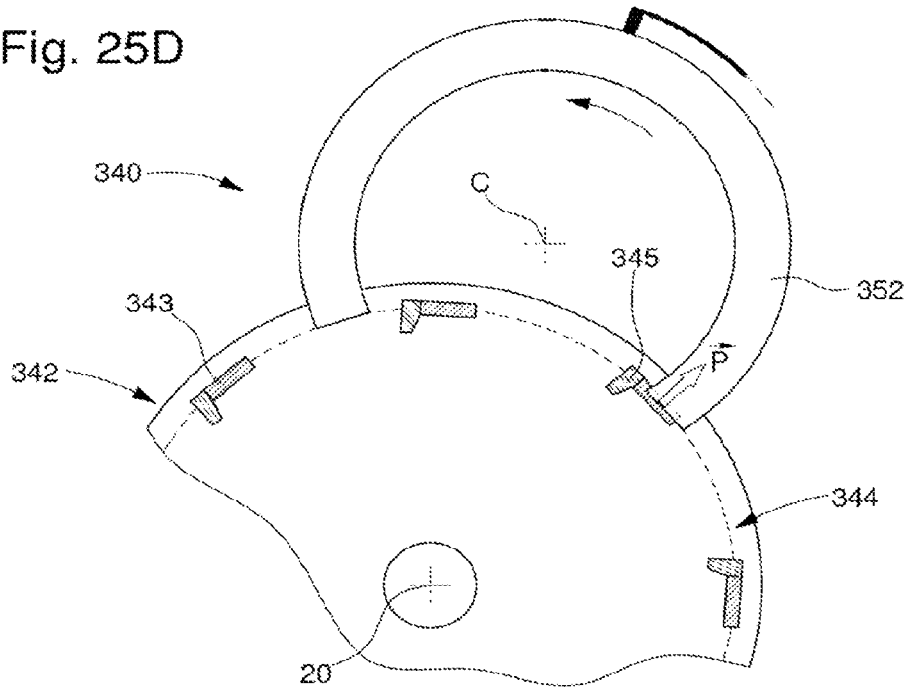

The magnet 352 defines in its general plane a truncated annular surface. In the variant proposed here, the opening $\theta_A$ of said truncated annular surface, defined as the angle at the axis of rotation 20 from the mid-point of the two exit lines, is substantially equal to 150% of the angular period of the magnetic track, i.e. $\theta_A=3\cdot\theta_P/2$. In a first oscillation alternation of the balance wheel 348, a first magnet 343 of the magnetic track penetrates beneath the annular magnet by the outer line of penetration 354. In the useful torque range, owing to the arrangement of a magnetic end stop 345 following each magnet 343 (a significantly stronger interaction with the annular magnet for said magnetic end stop), the first magnet is finally in a particular maximum penetration position or final superimposition position. In said final superimposition position, the balance wheel can turn freely substantially throughout the first alternation (FIG. 25A) until it reaches substantially its rest position about which it receives a first pulse P (FIG. 25B). The balance wheel continues its rotation substantially at maximum speed and a second magnet preceding the first magnet, relative to the direction of rotation of the driving mobile, penetrates after a determined rotation of the escapement mobile beneath the annular magnet by the inner line of penetration 355. Said second magnet is also in a position of maximum penetration corresponding to a particular superimposition in part with the annular magnet during the greater part of the second alternation (FIG. 25C) before exiting by the exit line 357 around the rest position of the resonator (FIG. 25D) supplying a second pulse P to the balance wheel-spiral spring. It will be observed that, depending on the positioning of the magnetic end stop 345 relative to the magnet 343 and the torque, the magnet 343 may be completely superimposed on the annular magnet in the position of maximum penetration. The annular magnet forms the common active end portion at the coupling of the magnetic track to the resonator and in the two alternations of each period of oscillation. It will be observed that in the rest position (FIGS. 25B and 25D), the exit lines defined by said common active end portion each have an orientation according to the present invention, because said exit lines are substantially tangential to the median geometric circle 120.

It will therefore be observed that this embodiment, in its main operating mode, is characterised by an intermittent advance of the escapement mobile with a wide oscillation amplitude. The truncated annular ring forms a magnetic barrier for the magnetic end stops of the magnetic track, allowing a momentary halt of the escapement mobile, which then advances in steps (two steps for a rotation of an angular period). In a specific operating mode however it is possible to obtain a continuous or almost continuous advance. In the last case, the magnetic end stops are no longer necessary. It will be noted that this type of continuous or almost continuous advance is provided principally in the other embodiments. However, some embodiments, depending on the dimensioning of the resonator and of the magnetic structure, may also operate in an intermittent way.

Figure 26:
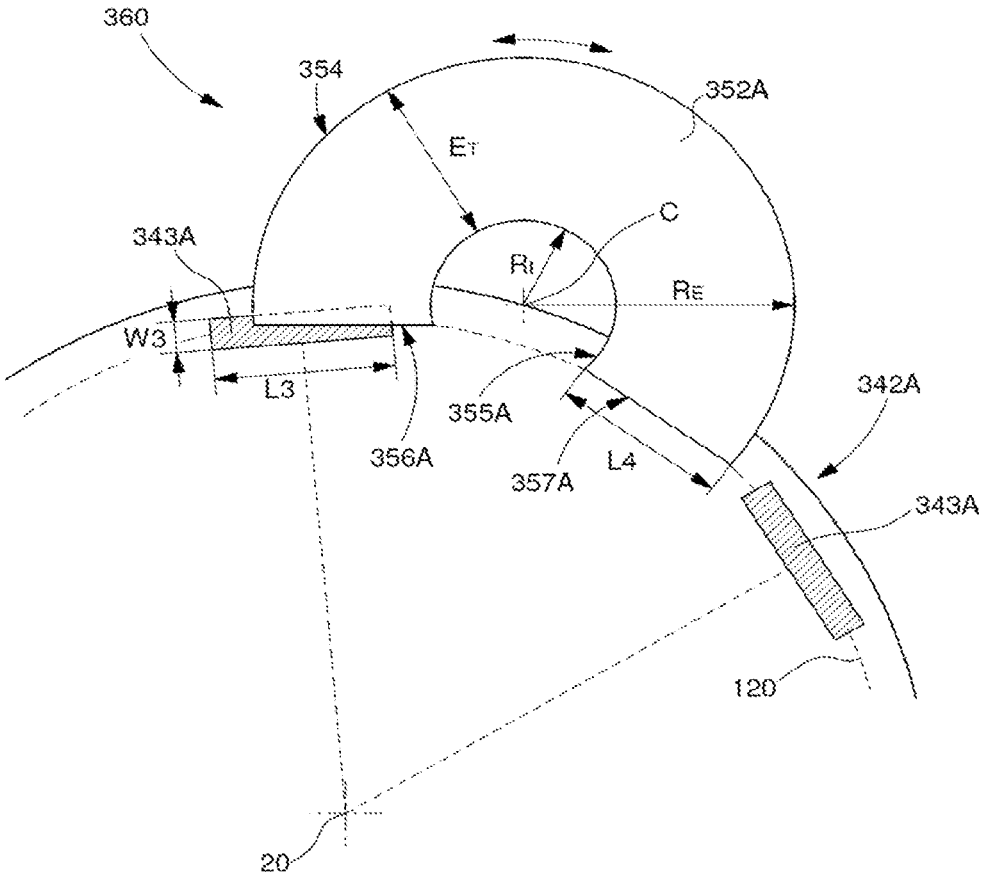
FIG. 26 is an advantageous variant of the tenth embodiment.

FIG. 26 shows a particular variant of the tenth embodiment (shown in a continuous operating mode of the escapement mobile). The regulating device 360 of the 'magnetic cylinder escapement' type is distinguished from the previous variant basically by the fact that provision is made for the same magnet 343A which is initially magnetically coupled to the annular magnet 352A of the resonator in a first alternation of a period of oscillation, penetrating beneath said annular magnet by the outer line of penetration 354 (substantially the same radius $R_E$ as in the previous variant) and exiting by the exit line 356A supplying a first pulse, and is then magnetically coupled directly to the annular magnet in the second alternation of said period of oscillation penetrating beneath said annular magnet by the inner line of penetration 355A before finally exiting by the exit line 357A supplying a second pulse to the balance wheel-spiral spring (not shown in FIG. 26). This type of configuration makes it possible, for a given outer diameter of the annular magnet of the resonator, to increase considerably the thickness $E_T$ of the wall of said cylindrical tube and thus the length L4 of the exit lines, as well as the longitudinal dimension L3 (angular or tangential dimension) of the magnets 343A of the magnetic track. This makes it possible to increase the accumulation of potential magnetic energy in the oscillator since, for a given first dimension W3, the second dimension L3 of said magnets can be increased, which therefore increases the ratio between said two dimensions. The opening of the annular magnet 352A, defined above, is less than an angular period of the magnetic track 342A.

In a particular embodiment of said variant, the annular magnet is mounted on, or suspended from, a structure comprising two crossed spring rods defining a geometric axis of oscillation C for the annular magnet. Said resiliently deformable structure is arranged on the other side of said annular magnet relative to the magnetic structure of the escapement mobile. Thus, no material axis is necessary in the region of the annular magnet and of the escapement mobile.

In a particular variant incorporating the variant shown, the diameter ($2 \cdot R_I$) of the inner contour of the truncated annular magnet is less than, or substantially equal to, the second dimension L3 of the second zones defined by the magnets of the magnetic track. The difference between the radii of the first and second circular lines of penetration 354 and 355A, corresponding to about the length L4 of the first and second exit lines, is substantially equal to the second dimension L3 or lies between eighty and one hundred and twenty percent (80% to 120%) of said second dimension.

Figure 27:
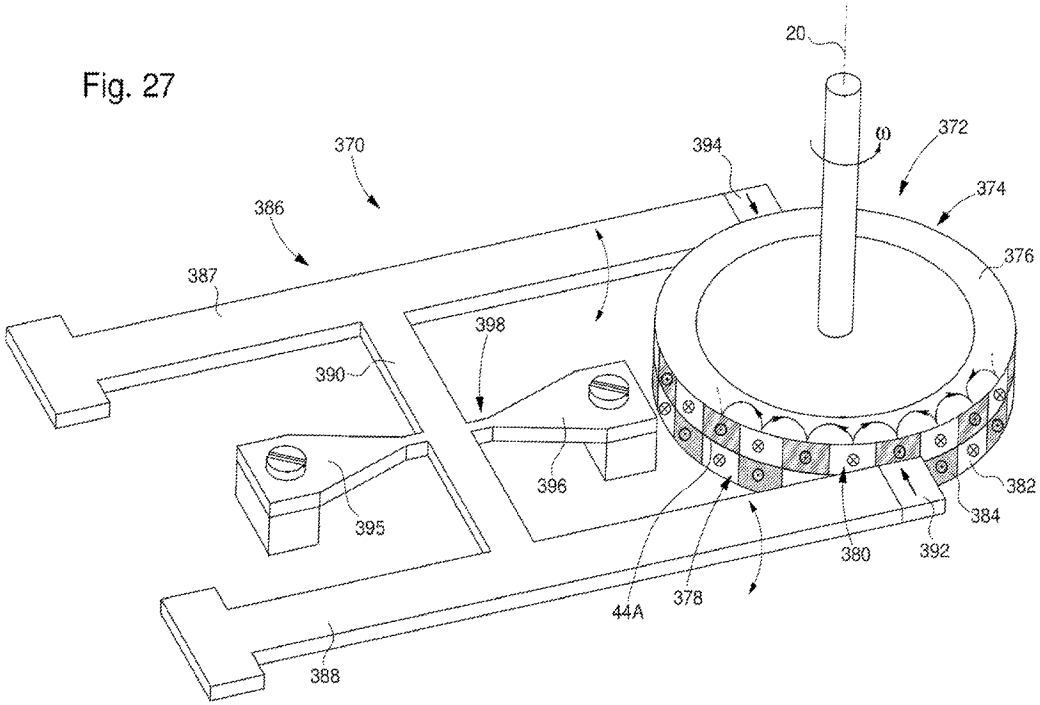
FIG. 27 shows diagrammatically an eleventh embodiment of the invention.

FIG. 27 shows an eleventh embodiment. The regulating device 370 is distinct in two main characteristics. Firstly, it comprises a magnetic escapement mobile 372 formed by a disk 374 with a non-magnetic central portion and a radially magnetised peripheral ring 376 so as to define two lateral magnetic tracks 378 and 380 each formed by alternating magnetic poles 382 and 384, said magnetic poles producing a magnetic flux corresponding to radial axes of magnetisation of alternating directions. They define first and second zones of each magnetic track. The second zones are in magnetic repulsion with the magnets 392 and 394 of the resonator whereas the first zones are in magnetic attraction with said magnets. The general geometric surface of the two magnetic tracks is a cylindrical surface such that the lines of penetration opposite the second zones for the magnets of the resonator are straight axial segments. The exit lines follow the interface circle of the two magnetic tracks, said interface circle preferably being merged with the zero position circle 44A defined by the orthogonal projection in the cylindrical surface of the centre of mass of the active end portion of each of the magnets 394 and 396 in the rest position. In other words, in this particular case, each of the centres of mass is on a radial axis of the disk 374 intercepting the interface circle of the two magnetic tracks when the first and second coupling elements are in the rest position.

Next, the resonator 386 is of the torsion type with two free ends of its resonant structure carrying respectively the first and second coupling elements. Said resonator has an H-shaped resonant structure with two small longitudinal bars 387 and 388, each carrying a coupling magnet 392, 394. Said two small longitudinal bars are connected by a small transverse bar 390 which has torsional deformation capacity. Provision is made for the small longitudinal bars to oscillate with a phase difference of 180° such that the small transverse bar is resiliently deformed torsionally about its longitudinal axis. Accordingly, there is an odd number of angular periods of the magnetic tracks, given by the number of pairs of reversed magnetic poles, and, as in the other embodiments with two magnetic tracks, said two magnetic tracks are angularly displaced by half an angular period, in other words shifted by 180°.

The two fixing portions 395 and 396 of the resonator are connected in the middle of the small transverse bar by two relatively narrow bridges 398, because in said median zone the material does not rotate about the longitudinal axis of the small transverse bar during substantially axial oscillation movements, in opposite directions, of the small longitudinal bars. The first and second zones 382 and 384 of the two magnetic tracks 378 and 380 of the turning magnetic structure and the two magnetic coupling elements 392 and 394 of the resonator are dimensioned and arranged in accordance with the criteria of the invention.

The invention claimed is:

1. A device for regulating the relative angular frequency ($\omega$) between a magnetic structure and a resonator magnetically coupled so as to define together an oscillator forming said regulating device, the magnetic structure comprising at least one annular magnetic track centred on an axis of rotation of said magnetic structure or of the resonator, the magnetic structure and the resonator being arranged to rotate in relation to one another about said axis of rotation when a torque is applied to the magnetic structure or to the resonator: the resonator comprising at least one magnetic element for a magnetic coupling to said annular magnetic track, said magnetic coupling element having an active end portion made of a first magnetic material and situated on the same side as said annular magnetic track; said annular magnetic track being made at least in part of a second magnetic material arranged such that the potential magnetic energy of the oscillator varies angularly and periodically along the annular magnetic track, thus defining an angular period ($\theta_P$) of said annular magnetic track, and defining magnetically first zones and second zones angularly alternating with a first zone and an adjacent second zone in each angular period: each second zone producing, relative to an adjacent first zone, a stronger repulsion force or a weaker attraction force for any same zone of said active end portion when said any same zone is superimposed, in orthogonal projection to a general geometric surface in which the annular magnetic track extends, respectively on said second zone or on said adjacent first zone: said magnetic coupling element being magnetically coupled to said annular magnetic track such that an oscillation by a degree of freedom of a resonant mode of the resonator is maintained within a useful range for the torque applied to the magnetic structure or to the resonator and that a such period of said oscillation occurs during said relative rotation in each angular period of said annular magnetic track, the frequency of said oscillation thus determining said relative angular frequency, said degree of freedom defining an axis of oscillation of said active end portion passing through its centre of mass; said resonator being arranged relative to said magnetic structure such that said active end portion is at least for the most part superimposed in orthogonal projection on said annular magnetic track during substantially a first alternation in each period of said oscillation, and such that the course taken by the magnetic coupling element during said first alternation is substantially parallel to said general geometric surface, the annular magnetic track having in said general geometric surface a dimension along the orthogonal projection of said axis of oscillation which is greater than the dimension of said active end portion along said axis of oscillation;

wherein each of said second zones has in orthogonal projection a general contour with a first portion, defining a line of penetration above said second zone for said active end portion of the magnetic coupling element during said oscillation, and with a second portion defining an exit line above said second zone for said active end portion during said oscillation, said exit line being oriented substantially in an angular direction parallel to a zero position circle which is centred on said axis of rotation and which passes through the orthogonal projection of the centre of mass of said active end portion in its rest position; wherein the magnetic structure also defines for the active end portion at least one exit zone which extends in said general geometric surface, said at least one exit zone receiving in orthogonal projection at least the greater part of said active end portion when said active end portion exits, during said oscillation, successively from the annular magnetic track by the respective exit lines of the second zones, said at least one exit zone producing, relative to said second zones, a weaker repulsion force or a stronger attraction force for any same zone of said active end portion when said any same zone is superimposed in orthogonal projection respectively on said at least one exit zone or on said second zones; wherein the active end portion of said coupling element in its rest position has, in orthogonal projection in said general geometric surface, a first dimension, along a first axis perpendicular to said zero position circle and passing through the orthogonal projection of the centre of mass of said active end portion, and a second dimension, along a second axis defined by said zero position circle, which is greater than said first dimension; and wherein said exit line of each of the two zones has a length, along said at least one exit zone and along said second axis, which is greater than the first dimension of the active end portion.

2. The device according to claim 1, wherein said exit line of each second zone is substantially merged with said zero position circle.

3. The device according to claim 2, wherein said useful torque range, said annular magnetic track, said at least one exit zone and said magnetic coupling element define in each angular period, depending on the relative position of said annular magnetic track and of said active end portion, an accumulation sector in which said oscillator basically accumulates potential magnetic energy and a pulse sector, adjacent to said accumulation sector, in which the magnetic coupling element basically receives a pulse, the pulse sectors being situated in a central pulse zone comprising the relative positions corresponding to said zero position circle.

4. The device according to claim 2, wherein said zero position circle and said axis of oscillation are substantially orthogonal at their point of intersection.

5. The device according to claim 1, wherein the second dimension of said active end portion is at least twice as great as its first dimension and said length of the exit line is at least twice as great as said first dimension.

6. The device according to claim 1, wherein the second dimension of said active end portion is at least four times greater than its first dimension and said length of the exit line is at least four times greater than said first dimension.

7. The device according to claim 1, wherein the orthogonal projection in said general geometric surface, said penetration line of each second zone is oriented substantially along said axis of oscillation when this penetration line is aligned with the centre of mass of said active end portion.

8. The device according to claim 1, wherein the exit line of said second zones along said at least one exit zone and said active end portion extend angularly relative to said axis of rotation over substantially half an angular period ($\theta_P$).

9. The device according to claim 1, wherein the dimension of each of said second zones, along an axis perpendicular to said zero position circle at a mid-point of said exit line, is at least three times as great as the first dimension of said active end portion.

10. The device according to claim 1, wherein the dimension of each of said second zones, along an axis perpendicular to said zero position circle at a mid-point of said exit line, is at least six times greater than the first dimension of said active end portion.

11. A device for regulating the relative angular frequency ($\omega$) between a magnetic structure and a resonator magnetically coupled so as to define together an oscillator forming said regulating device, the magnetic structure comprising at least one annular magnetic track centred on an axis of rotation of said magnetic structure or of the resonator, the magnetic structure and the resonator being arranged to rotate in relation to one another about said axis of rotation when a torque is applied to the magnetic structure or to the resonator; the resonator comprising at least one element for a magnetic coupling to said annular magnetic track, said magnetic coupling element having an active end portion made of a first magnetic material and situated on the same side as said annular magnetic track; said annular magnetic track being made at least in part of a second magnetic material arranged such that the potential magnetic energy of the oscillator varies angularly and periodically along the annular magnetic track, thus defining an angular period ($\theta_P$) of said annular magnetic track; said magnetic coupling element being magnetically coupled to the annular magnetic track such that an oscillation by a degree of freedom of a resonant mode of the resonator is maintained within a useful range for the torque applied to the magnetic structure or to the resonator and that a period of said oscillation occurs during said relative rotation in each angular period of the annular magnetic track, the frequency of said oscillation thus determining said relative angular frequency, said degree of freedom defining an axis of oscillation of said active end portion passing through its centre of mass;

wherein said second magnetic material is arranged along the annular magnetic track such that said second magnetic material defines magnetically first zones and second zones angularly alternating with a first zone and an adjacent second zone in each angular period; wherein, during said oscillation in said useful torque range, said active end portion of said magnetic coupling element defines magnetically, in orthogonal projection in a general geometric surface in which said active end portion extends overall and comprising said axis of oscillation:

an entry zone successively for said second zones in orthogonal projection to the general geometric surface, a potential magnetic energy accumulation zone in the oscillator, which is angularly adjacent to the entry zone and in which penetrates in orthogonal projection at least in part each second zone from said entry zone, and an exit zone adjacent to the potential magnetic energy accumulation zone, said exit zone receiving in orthogonal projection at least the greater part of each second zone exiting from said accumulation zone or from a following second zone;

each second zone producing per unit of angular length, relative to a first zone, a stronger repulsion force for said potential magnetic energy accumulation zone or a stronger attraction force for said entry zone and said exit zone; said potential magnetic energy accumulation zone producing, relative to said entry zone and said exit zone, a stronger repulsion force or a weaker attraction force for any same zone of each second zone when said any same zone is superimposed respectively on said potential magnetic energy accumulation zone, on the entry zone or on the exit zone; wherein said annular magnetic track has, in orthogonal projection in said general geometric surface, a dimension along said axis of oscillation that is smaller than the dimension along said axis of oscillation of said active end portion; wherein the resonator is arranged relative to the magnetic structure such that the potential magnetic energy accumulation zone is traversed in orthogonal projection by a median geometric circle, passing through the middle of the annular magnetic track, during substantially a given alternation in each period of said oscillation; wherein said potential magnetic energy accumulation zone has a general contour with a first portion, defining a line of penetration beneath said accumulation zone successively for each of said second zones during said oscillation, and with a second portion defining an exit line from beneath said accumulation zone for said second zone or a following second zone during said oscillation, the exit line being oriented, when said magnetic coupling element is in its rest position, substantially in an angular direction parallel to the orthogonal projection of said median geometric circle; wherein each of said second zones has in orthogonal projection, when the centre of said second zone is superimposed on said axis of oscillation, a first dimension, along a first axis perpendicular to the orthogonal projection of the median geometric circle and passing through the point of intersection of said orthogonal projection of the median geometric circle with the axis of oscillation, and a second dimension, along a second axis perpendicular to the first axis and passing through said point of intersection, which is greater than the first dimension; and wherein, when the magnetic coupling element is in its rest position, said exit line has a length, along said exit zone and along said second axis, which is greater than the first dimension of the second zones.

12. The device according to claim 11, wherein said exit line of said potential magnetic energy accumulation zone is substantially merged with said orthogonal projection of said median geometric circle when said coupling element is in its rest position.

13. The device according to claim 11, wherein said useful torque range, said annular magnetic track and said magnetic coupling element define in each angular period, depending on the relative position of said annular magnetic track and of said active end portion, an accumulation sector in which said oscillator basically accumulates potential magnetic energy and a pulse sector, adjacent to said accumulation zone, in which the coupling element basically receives a pulse, the pulse sectors being situated in a central pulse zone corresponding substantially to the annular magnetic track.

14. The device according to claim 11, wherein said axis of oscillation and said median geometric circle are, in orthogonal projection to said general geometric surface, substantially orthogonal at their point of intersection.

15. The device according to claim 11, wherein the second dimension of each second zone is at least twice as great as its first dimension, and said length of the exit line is at least twice as great as said first dimension.

16. The device according to claim 11, wherein the second dimension of each second zone is at least four times greater than its first dimension, and said length of the exit line is at least four times greater than said first dimension.

17. The device according to claim 11, wherein said line of penetration in said potential magnetic energy accumulation zone is oriented in a direction substantially parallel to said axis of oscillation.

18. The device according to claim 11, wherein said line of penetration in said potential magnetic energy accumulation zone defines a path along said degree of freedom.

19. The device according to claim 11, wherein the exit line of said potential magnetic energy accumulation zone along said exit zone and each second zone extends angularly over substantially half an angular period.

20. The device according to claim 11, wherein the dimension of said line of penetration in said potential magnetic energy accumulation zone along said axis of oscillation is at least five times greater than the dimension, in orthogonal projection in said general geometric surface, of the annular magnetic track along said axis of oscillation.

21. The device according to claim 11, wherein the dimension of said line of penetration in said potential magnetic energy accumulation zone along said axis of oscillation is at least eight times greater than the dimension, in orthogonal projection in said general geometric surface, of the annular magnetic track along said axis of oscillation.

22. The device according to claim 1, wherein said general geometric surface is a cylindrical surface having as its central axis said axis of rotation, said degree of freedom being substantially oriented along said axis of rotation.

23. The device according to claim 1 and in which said annular magnetic track defines a first track, wherein said magnetic structure further comprises a second annular magnetic track also coupled to said coupling element in a similar way as said coupling element is coupled to the first track; the second track being made at least in part of a magnetic material that has a variation along said second track such that the potential magnetic energy of the oscillator varies angularly, with said angular period and in a similar way to the variation of the first track, along said second track, the first and second tracks having an angular displacement equal to half said angular period.

24. The device according to claim 1, wherein said annular magnetic track defines a first track, the device further comprising a second annular magnetic track made at least in part of a magnetic material and coupled to said coupling element or to another coupling element in a similar way as said coupling element is coupled to the first track; the second track being made at least in part of a magnetic material that has a variation along said track such that the potential magnetic energy of the oscillator varies angularly, in a similar way to the variation for the first track, also along said second track; and wherein the first and second tracks are respectively rigidly connected in rotation to two mobiles having separate axes of rotation.

25. The device according to claim 24, wherein the two mobiles have at their periphery respectively two sets of teeth that mesh directly with one another.

26. The device according to claim 1, wherein said magnetic coupling element is a first coupling element, the device further comprising at least a second coupling element also magnetically coupled to said magnetic track in a similar way to the first coupling element.

27. The device according to claim 26, wherein said resonator is of the balance wheel-spiral spring type or of the balance wheel with spring rods type, the balance wheel carrying the first and second coupling elements.

28. The device according to claim 26, wherein said resonator is formed by diapason of which two free ends of its resonant structure carry respectively the first and second magnetic coupling elements.

29. The device according to claim 26, wherein said resonator is of the torsion type with two free ends of its resonant structure carrying respectively the first and second magnetic coupling elements.

30. The device according to claim 11, wherein said active end portion of said coupling element is formed substantially by a truncated annular magnet having a central axis merged with an axis of rotation of the resonator, said degree of freedom being angular and said axis of oscillation being circular, said truncated annular magnet defining in said general geometric surface a truncated annular surface corresponding to the potential magnetic energy accumulation zone successively in the two alternations of each period of oscillation, said truncated annular surface having a first end and a second end as well as an outer contour defining said line of penetration, which is a first circular line of penetration, and an inner contour defining a second circular line of penetration; wherein the first end defines said exit line, which is a first exit line, and the second end defines a second exit line having similar characteristics to the first exit line; and wherein the outer contour is associated with the first exit line in a first alternation of the periods of oscillation of the resonator in order to provide successively the magnetic coupling in repulsion with said second zones of the magnetic track and to produce a first pulse at the end of each first alternation, whereas the inner contour is associated with the second exit line in order to provide successively the magnetic coupling in repulsion with said second zones in the second alternation of the periods of oscillation and to produce a second pulse at the end of each second alternation.

31. The device according to claim 30, wherein the opening of said truncated annular surface is smaller than said angular period, and wherein the diameter of the inner contour of said truncated annular surface is substantially equal to said second dimension of the second zones or less than this second dimension.

32. The device according to claim 1, wherein said first and second magnetic materials are materials that are magnetised in repulsion.

33. A horological movement comprising a regulating device according to claim 1, said regulating device defining a resonator and a magnetic escapement, and serving to regulate the operation of at least one mechanism of said horological movement.

* * * * *